US010654635B2

(12) United States Patent
Schnabel et al.

(10) Patent No.: US 10,654,635 B2
(45) Date of Patent: May 19, 2020

(54) TRANSPARENT RETAIL BAG-IN-BOX PACKAGE

(71) Applicant: BEMIS COMPANY, INC., Neenah, WI (US)

(72) Inventors: Donald C. Schnabel, Oshkosh, WI (US); Peter M. Chen, Appleton, WI (US); Jay D. Hodson, Hortonville, WI (US)

(73) Assignee: Bemis Company, Inc., Neenah, WI (US)

( * ) Notice: Subject to any disclaimer, the term of this patent is extended or adjusted under 35 U.S.C. 154(b) by 0 days.

(21) Appl. No.: 15/501,218

(22) PCT Filed: Aug. 8, 2014

(86) PCT No.: PCT/US2014/050344

§ 371 (c)(1),
(2) Date: Feb. 2, 2017

(87) PCT Pub. No.: WO2016/022148

PCT Pub. Date: Feb. 11, 2016

(65) Prior Publication Data

US 2017/0225862 A1 Aug. 10, 2017

(51) Int. Cl.
*B65D 77/06* (2006.01)
*B65D 35/56* (2006.01)
(Continued)

(52) U.S. Cl.
CPC ..... *B65D 77/065* (2013.01); *B65D 5/103* (2013.01); *B65D 25/54* (2013.01); *B65D 77/068* (2013.01); *B65D 35/56* (2013.01); *B65D 77/06* (2013.01)

(58) Field of Classification Search
CPC .. B65D 77/065; B65D 77/067; B65D 77/062; B65D 77/06; B65D 88/1656; B67D 3/0067
(Continued)

(56) References Cited

U.S. PATENT DOCUMENTS 225,900 A 3/1880 Whiteman
1,157,462 A 10/1915 Van Wormer
(Continued)

FOREIGN PATENT DOCUMENTS

DE 1120355 7/1962
DE 3629260 A1 3/1988
(Continued)

OTHER PUBLICATIONS

Meiri, Jonathan et al., "Tetra Pak—From 1 to 165 countries in less than 50 years—High Tech and Entrepreneurial Strategy INSEAD", Jun. 2003, retrieved online Aug. 7, 2014 at http://www.lopdf.net/d/Tetra-Packaging.pdf.

*Primary Examiner* — Justin M Larson
(74) *Attorney, Agent, or Firm* — Lynn M. Nett

(57) ABSTRACT

A retail bag-in-box transparent package having a flovvable product contained in a bag which is contained in a polymeric box where the box has (i) a flat bottom panel, an opposing top panel, and a self-supporting, upstanding, at least partially transparent wail connecting the bottom and top panels, and (ii) an access port through the box adapted for providing communication means for removing product from the bag, which is a flexible thermoplastic bag (capacity ≤1 liter (1000 ml)) attached to an interior surface of the box proximate the access port, where at least a portion of the bag has a transparent wall overlapping the transparent box portion to provide visual access to the product.

18 Claims, 5 Drawing Sheets

(51) Int. Cl.
*B65D 25/54* (2006.01)
*B65D 5/10* (2006.01)

(58) Field of Classification Search
USPC ..... 229/117.3, 117.32, 117.28; 220/495.05; 222/105, 92; 206/229, 427
See application file for complete search history.

(56) References Cited

U.S. PATENT DOCUMENTS 2,365,159 A * 12/1944 Walton ..... B65D 5/703 229/117.3
3,090,526 A 5/1963 Hamilton et al.
3,184,117 A 5/1965 Sanderson
3,314,210 A 4/1967 Jarund
3,380,646 A 4/1968 Doyen et al.
3,935,968 A 2/1976 Rausing
4,064,206 A 12/1977 Seufert
4,179,252 A 12/1979 Seufert
4,348,449 A 9/1982 Seufert
4,459,793 A 7/1984 Zenger
4,560,090 A * 12/1985 Okushita ..... B65D 5/606 222/105
4,590,126 A 5/1986 Andersson
4,660,737 A 4/1987 Green et al.
4,706,827 A 11/1987 Cahernoch et al.
4,759,642 A 7/1988 Van Erden et al.
4,778,053 A 10/1988 Hakansson
4,846,775 A 7/1989 Herrin
4,858,756 A 8/1989 Herrin et al.
5,049,349 A 9/1991 McCullough et al.
5,069,334 A 12/1991 Herrin et al.
5,096,306 A 3/1992 Perrson et al.
5,117,972 A 6/1992 Herrin et al.
5,156,295 A * 10/1992 Gordon ..... B65D 77/065 220/712
5,421,485 A 6/1995 Furuta et al.
5,458,233 A 10/1995 Herrin
5,499,484 A 3/1996 Herrin
5,526,958 A * 6/1996 Kuppersbusch ..... B65D 77/065 222/103
5,579,935 A 12/1996 Atkin et al.
5,599,267 A 2/1997 Dupuy
5,799,818 A * 9/1998 Ringer ..... B65D 77/065 220/62.21
5,803,302 A * 9/1998 Sato ..... B65D 77/065 229/117.3
5,860,555 A * 1/1999 Mayled ..... B65D 5/6608 220/495.05
6,004,251 A 12/1999 Herrin
6,116,782 A 9/2000 Arkins et al.
6,270,867 B1 * 8/2001 Eckstein ..... B29D 7/01 156/244.13
6,378,733 B1 * 4/2002 Boonzaier ..... B65D 5/103 220/630
6,598,757 B2 7/2003 Stillinger et al.
6,609,636 B1 8/2003 Petriekis et al.
6,637,623 B2 * 10/2003 Muise ..... B65D 5/5045 222/105
7,276,281 B2 10/2007 Tyler et al.
7,681,783 B2 * 3/2010 Stephenson ..... B65D 5/46008 220/495.01
7,708,143 B2 * 5/2010 Adams ..... A45C 11/20 206/541
7,798,711 B2 9/2010 Plunkett et al.
7,967,163 B1 6/2011 Martin
7,993,692 B2 * 8/2011 Finley ..... B65D 81/3294 206/219
8,261,964 B2 9/2012 Raupach et al.
8,342,389 B2 1/2013 Mills et al.
8,556,124 B2 * 10/2013 Edwards ..... B65D 77/068 222/105
8,672,184 B2 * 3/2014 Edwards ..... B65D 77/067 222/105
9,016,555 B2 * 4/2015 Plunkett ..... B65D 77/065 220/666
9,193,512 B2 * 11/2015 Brooks ..... B65D 77/067
2005/0103802 A1 * 5/2005 Alberg ..... B65D 23/02 222/105
2005/0236427 A1 10/2005 Farha et al.
2006/0243783 A1 11/2006 Spivey et al.
2008/0048367 A1 * 2/2008 Falat ..... B29C 53/06 264/442
2009/0212071 A1 * 8/2009 Tom ..... B65B 31/003 222/95
2009/0266737 A1 10/2009 Cole
2010/0019021 A1 * 1/2010 Dixon-Garrett ..... B65D 3/22 229/117.27
2010/0065457 A1 3/2010 Halstrom et al.
2010/0147884 A1 * 6/2010 Compton ..... B67D 7/0205 222/105
2010/0230438 A1 9/2010 Sardo, Jr.
2011/0031243 A1 * 2/2011 Lester ..... B29C 49/0005 220/23.87
2011/0083768 A1 * 4/2011 Sims ..... B65D 88/54 141/2
2012/0217265 A1 * 8/2012 Edwards ..... B65D 77/067 222/105
2013/0126592 A1 * 5/2013 Bellmore ..... B65D 5/56 229/117.27
2013/0260069 A1 * 10/2013 Wang ..... B32B 15/08 428/35.9
2014/0312063 A1 * 10/2014 Owensby ..... B65D 83/38 222/105
2014/0366484 A1 * 12/2014 Galbasini ..... B65D 75/008 53/410
2016/0304332 A1 * 10/2016 Georgelos ..... B32B 27/18
2017/0225862 A1 * 8/2017 Schnabel ..... B65D 77/065
2018/0362238 A1 * 12/2018 Chen ..... B65D 77/068

FOREIGN PATENT DOCUMENTS

DE 29814003 11/1998
EP 0934209 B1 3/2001
EP 0963327 B1 7/2002
EP 2468661 A1 6/2012
JP 01110029 A 4/1989
JP 08085148 A 4/1996
WO 03059777 A1 7/2003

* cited by examiner

TRANSPARENT RETAIL BAG-IN-BOX PACKAGE

BACKGROUND

1. Technical Field

The present application relates generally to retail packaging suitable for packaging family or small group sized portions of liquid or flowable products such as juice, milk, syrup, wine, sauces, oils, soup, broth, sugar, salt, confectionery pieces, birdseed, food or non-food particles, pellets, or liquids, skin care products, jewelry beads, BB shot, etc.

2. Background Information

Retail packaging for flowable solid and/or liquid products is commercially available in many styles and sizes e.g. 6-8 ounce single serve juice boxes, stand up pouches (SUPs) containing alcoholic or non-alcoholic beverages, retort and aseptic boxes for a range of food items such as broths, soups, milk, fruit or vegetable juices or purees, etc. Both food and nonfood retail packages are available in a wide variety of sizes and shapes. For example, metal cans made from aluminum, steel and other materials are well known. Plastic and glass jars, bottles and tubs as well as plastic and paper bags including pouches, envelopes, stick packages, etc. are all ubiquitous in modern commerce. Suitable packaging, e.g. for flowable articles which comprise (i) liquids or (ii) a multitude of small solid products ranging from items such as cinnamon candies to BB shot, should contain the product within the package while protecting the product from contamination and deleterious effects from the external environment. Thus, containers may protect their contents from contact or exposure to unwanted materials such as dirt, dust, microbes, insects, air, moisture, sunlight, etc. Also, the materials used in constructing packaging and especially for a product such as a food (including drink) or drug, the product contact interior surface layer of the package should resist migration of chemicals between the product and the package materials. Examples of prior art packaging include U.S. Pat. Nos. 225,900; 1,157,462; and 3,314,210.

As previously noted, disposable, single serve, drink boxes and beverage pouches are well-known in the art, see e.g. U.S. Pat. No. 3,380,646 (Doyen). Typically, a drink box comprises a cardboard box, laminated with plastic, and lined with a metal foil or plastic liner that contains a beverage, typically a fruit flavored drink or non-carbonated juice such as apple, grape, or orange juice, see e.g. U.S. Pat. No. 4,590,126 for an example of a laminate material that may be employed. The beverage product contained in a single serve drink box is typically consumed through a straw. Often a rigid plastic straw is provided with each box for insertion through a hole in the cardboard box which provides an access point for piercing the liner with an end of the straw, see e.g. U.S. Pat. Nos. 4,660,737 and 4,778,053.

Similarly, single serve stand up pouches (SUPs) for beverages typically comprise flexible laminates of metal foil and plastic, where e.g. the edges of a folded laminate or a plurality of laminate sheets are sealed together to form a pouch. As with drink boxes, an access point is provided in a small area of the pouch to permit a straw to easily pierce a wall of the pouch to provide access to its contents. Such a pouch is disclosed in U.S. Pat. No. 5,425,583 (Wild); and U.S. Pat. No. 6,116,782 (Arkins et al.)

Thus, many commercially available food products, including fruit juice, wine, milk, tomato puree, etc., are packed in packages which are manufactured using a sterilized packaging material. A typical example of this kind of package is the parallelepipedal packaging container for liquid or pourable food products, which is manufactured by folding and sealing of a laminated packaging material, and which is commercially available from Tetra Pak International SA, Lucernne, Switzerland under the trademarked brand Tetra Brik® Aseptic, or from SIG Combibloc GmbH, Linnich, Germany under the trade name Combibloc® Aseptic. The laminated packaging material comprises layers of paper, which are coated on both sides with a thermoplastic material such as polyethylene. Between the food contact side of the laminated packaging material and the paper layer(s), there is also a layer of an oxygen barrier material, such as e.g., aluminum foil.

Parallepipedal packaging containers of this type are made using packaging filling machines which are fed with laminated packaging material in web form. The packaging material web is sterilized in the packaging machine by the application of a chemical sterilization agent such as e.g., hydrogen peroxide solution. After chemical sterilization, the chemical agent is removed from the packaging material surface, e.g., by heat vaporization. Then the sterilized packaging material is maintained in a sterile environment while being folded and longitudinally sealed to form a tube. This sterile tube is filled with sterilized food product and then transversely sealed and cut into pillow-shaped packages, which are then mechanically folded to form a parallepipedal package.

An example of this type of packaging machine is the TBA19 aseptic filling machine, manufactured by Tetra Brik Packaging Systems, Via Delfini 1, Modena, Italy.

Both single serve, drink boxes and beverage SUPS are intended to be disposable, and, therefore require solid waste disposal. Unlike beverage bottles formed from a recyclable plastic, such as polyethylene terephthalate, laminated drink boxes and SUPS are difficult or impractical to recycle. Laminates of aluminum foil with plastic and often paper in these drink boxes and SUPs present difficulties in separation of the different layers which makes the expense of recycling too great for commercial acceptance.

BRIEF SUMMARY

A retail bag-in-box package having a flowable product contained in a thermoplastic bag which is contained in a paperless, polymeric plastic box is provided. The plastic box has (i) a flat bottom panel, an opposing top panel, and a self-supporting, upstanding, at least partially transparent, wall connecting the bottom and top panels, and (ii) an access port through the box adapted for providing communication means for removing product from the bag. The bag is a retail sized, flexible thermoplastic bag (capacity ≤1 liter) attached to an interior surface of the box proximate the access port, where at least a portion of the bag has a transparent wall overlapping the transparent box portion to provide visual access to a liquid or flowable product contained in the bag.

The inventive package is suitable for packaging small flowable articles or products (including either solids and/or liquids) of a size typical for consumer or individual use. Examples of products which may be packaged in accordance with the present invention include without limitation: milk, fruit or vegetable juices or purees such as: apple, apricot, black currant, cherry, grape, peach, pear, pineapple, or pomegranate juice; citrus juices like orange, grapefruit, and lemon juice; carrot juice; tomato juice or puree; non-alcoholic or alcoholic drinks such as water, flavored water, juice, tea, or wine; honey; syrups for sweetening foods e.g. pancake syrup; syrups for flavoring beverages e.g. soft drinks including homemade lemonade, juice flavored drinks, and in carbonated home beverage makers such as the Sodastream Home Soda Maker available from Soda Stream Direct, LLC.; or foods or food ingredients or condiments such as broth, soup, vinegar, soy sauce, ketchup, prepared mustard, mayonnaise, sauces, seeds, nuts, mints, or gum pieces; oils such as olive oil, coconut oil, walnut oil, peanut oil, etc.; salad dressings; retort applications; drugs or physiologically active substances such as aspirin pills or vitamins; personal care products such as soap, lotion, humectants, conditioners, nail polish, nail polish removers; and other small flowable items, such as household or garden chemicals, liquids such as alcohol, mineral oil, motor oil, lubricants, as well as BB shot, decorative beads, household cleaners, plant fertilizer, or pesticides, etc. Packaged products may be acidic or neutral or basic, caffeinated or non-caffeinated, refrigerated or shelf-stable at room temperature (RT) (at ~23° C.). The product and packaging may also be pasteurized, high pressure pasteurized, retorted, irradiated, and/or sterilized e.g. high temperature short time (HTST) sterilized, ultra-high temperature (UHT) sterilized, heat sterilized, steam sterilized, chemically sterilized e.g. with peroxide or peroxyacetic acid, and/or aseptically packaged. They may also be frozen and re-thawed for consumption or use.

According to the present invention the package may in an alternative embodiment advantageously employ a bag having: (a) a chemically inert product contact layer e.g. of PET or a norbornene ethylene copolymer or derivative thereof;

(b) an oxygen barrier layer;

(c) a water vapor barrier layer;

wherein the bag film has the following properties:

(i) an oxygen transmission rate ($O_2TR$) of less than less than 10 $cm^3$/100 $inches^2$/24 hours at 1 atmosphere and 23° C. and 0% R.H.; and (ii) a water vapor transmission rate (WVTR) of less than 0.5 g/100 $inches^2$ per 24 hours at 100° F. (38° C.), 90% R.H. and 1 atmosphere; and a thickness of 5 mil or less.

DETAILED DESCRIPTION

Definitions and Nomenclature

Figure 1:
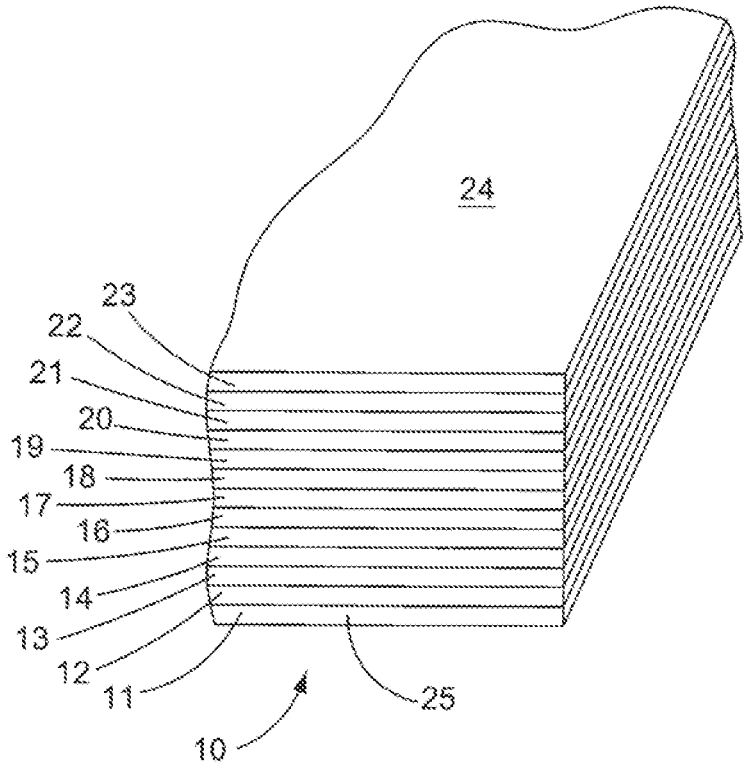
FIG. 1 is a schematic view of a portion of a flexible thermoplastic web of film.

As used herein "retail" packaging is sized for consumer use, typically less than ½ gallon, i.e. sized for family or other small group use rather than the larger sizes associated with institutional, catering, restaurant, hospital services, etc.

In discussing polymers, plastic films and packaging, various acronyms are used herein and they are listed below. Also, in referring to blends of polymers a colon (:) will be used to indicate that the components to the left and right of the colon are blended. In referring to film or box structure, a slash "/" will be used to indicate that components to the left and right of the slash are in different layers and the relative position of components in layers may be so indicated by use of the slash to indicate layer boundaries. Acronyms and terms commonly employed herein include:

PET—polyethylene terephthalate

APET—amorphous polyethylene terephthalate

OPET—biaxially oriented polyethylene terephthalate

PETG—glycolized polyethylene terephthalate

RPET—recycled polyethylene terephthalate

COC—a cyclic olefin copolymer such as ethylene norbornene copolymer

PE-Polyethylene (ethylene homopolymer and/or copolymer of a major portion of ethylene with one or more α-olefins)

LDPE—low density polyethylene

LLDPE—linear low density polyethylene mLLDPE—metallocene catalyzed linear low density polyethylene $C_2$—ethylene monomer $C_4$—butene-1 monomer $C_6$—hexene-1 monomer $C_8$—octene-1 monomer $C_{10}$-decene-1 monomer $C_2C_x$—a substantially linear copolymer of ethylene and an α-olefin where "x" indicates the number of carbon atoms in the comonomer.

EAO—Ethylene α-olefin copolymer

VA—Vinyl Acetate

EVA—Copolymer of ethylene with vinyl acetate

EVOH—a saponified or hydrolyzed copolymer of ethylene and vinyl acetate

EAA—Copolymer of ethylene with acrylic acid

EMA—ethylene methacrylic acid copolymer ionomer—an ethylene-methacrylate acid copolymer whose acid groups have been neutralized partly or completely to form a salt, preferably a zinc or sodium salt PP—polypropylene PCTFE—Polychlorotrifluoroethylene PVC—polyvinyl chloride (also includes copolymers that contain at least 50% vinyl chloride)

PVDC—polyvinylidene chloride (also includes copolymers of vinylidene chloride, especially with vinyl chloride)

The term "adhesive layer," or "tie layer," refers to a layer or material placed on one or more layers to promote the adhesion of that layer to another surface. Preferably, adhesive layers are positioned between two layers of a multilayer film to maintain the two layers in position relative to each other and prevent undesirable delamination. Unless otherwise indicated, an adhesive layer can have any suitable composition that provides a desired level of adhesion with the one or more surfaces in contact with the adhesive layer material. Optionally, an adhesive layer placed between a first layer and a second layer in a multilayer film may comprise components of both the first layer and the second layer to promote simultaneous adhesion of the adhesive layer to both the first layer and the second layer to opposite sides of the adhesive layer.

As used herein, unless otherwise indicated, the phrases "seal layer," "sealing layer," "heat seal layer," and "sealant layer," refer to a film or box layer, or layers, involved in the sealing of the film or box. In general, the sealant layer is a surface layer i.e. an exterior or an interior layer of any suitable thickness, that provides for the sealing to itself or another layer or article. The interior surface seal layer frequently can also serve as an article contact layer in the packaging of articles.

The terms "heat sealing layer" or "sealant layer" are used interchangeably to refer to a layer which is heat sealable i.e., capable of fusion bonding by conventional indirect heating means which generate sufficient heat on at least one contact surface for conduction to the contiguous contact surface and formation of a bond interface therebetween without loss of the integrity. The bond interface between contiguous inner layers preferably has sufficient physical strength to withstand the packaging process and subsequent handling. Advantageously, the bond interface is preferably sufficiently thermally stable to prevent gas or liquid leakage therethrough when exposed to above or below ambient temperatures e.g. during one or more of the following: packaging operations, storage, handling, and transport. Heat seals may be designed to meet different conditions of expected use and various heat seal formulations are known in the art and may be employed with the present invention. Preferably the article contact or heat seal layer is heat sealable to itself, but may be sealable to other objects, films or layers e.g. to a tray when used as a lidding film, or to an outer layer in a lap seal or in certain tray overwrap embodiments.

"Polyolefin" is used herein broadly to include polymers such as polyethylene, ethylene-alpha olefin copolymers (EAO), polypropylene, polybutene, ethylene copolymers having a majority amount by weight of ethylene polymerized with a lesser amount of a comonomer such as vinyl acetate, and other polymeric resins falling in the "olefin" family classification. Polyolefins may be made by a variety of processes well known in the art including batch and continuous processes using single, staged or sequential reactors, slurry, solution and fluidized bed processes and one or more catalysts including for example, heterogeneous and homogeneous systems and Ziegler, Phillips, metallocene, single site and constrained geometry catalysts to produce polymers having different combinations of properties. Such polymers may be highly branched or substantially linear and the branching, dispersity and average molecular weight may vary depending upon the parameters and processes chosen for their manufacture in accordance with the teachings of the polymer arts.

"Polyethylene" is the name for a polymer whose basic structure is characterized by the chain $—(CH_2—CH_2—)_n$. Polyethylene homopolymer is generally described as being a solid at room temperature (RT) (~23° C.) and which has a partially amorphous phase and partially crystalline phase with a density of between 0.915 to 0.970 g/cm$^3$. The relative crystallinity of polyethylene is known to affect its physical properties. The amorphous phase imparts flexibility and high impact strength while the crystalline phase imparts a high softening temperature and rigidity.

Unsubstituted polyethylene is generally referred to as high density homopolymer and has a crystallinity of 70 to 90 percent with a density between about 0.96 to 0.97 g/cm$^3$. Most commercially utilized polyethylenes are not unsubstituted homopolymer but instead have $C_2$-$C_8$ alkyl groups attached to the basic chain. These substituted polyethylenes are also known as branched chain polyethylenes. Also, commercially available polyethylenes frequently include other substituent groups produced by copolymerization. Branching with alkyl groups generally reduces crystallinity, density and melting point. The density of polyethylene is recognized as being closely connected to the crystallinity. The physical properties of commercially available polyethylenes are also affected by average molecular weight and molecular weight distribution, branching length and type of substituents.

People skilled in the art generally refer to several broad categories of polymers and copolymers as "polyethylene." Placement of a particular polymer into one of these categories of "polyethylene" is frequently based upon the density of the "polyethylene" and often by additional reference to the process by which it was made since the process often determines the degree of branching, crystallinity and density. In general, the nomenclature used is nonspecific to a compound but refers instead to a range of compositions. This range often includes both homopolymers and copolymers.

For example, "high density" polyethylene (HDPE) is ordinarily used in the art to refer to both (a) homopolymers of densities between about 0.960 to 0.970 g/cm$^3$ and (b) copolymers of ethylene and an α-olefin (usually 1-butene or 1-hexene) which have densities between 0.940 and 0.958 g/cm$^3$. HDPE includes polymers made with Ziegler or Phillips type catalysts and is also said to include high molecular weight "polyethylenes." In contrast to HDPE, whose polymer chain has some branching, are "ultra high molecular weight polyethylenes" which are essentially unbranched specialty polymers having a much higher molecular weight than the high molecular weight HDPE.

Hereinafter, the term "polyethylene" will be used (unless indicated otherwise) to refer to ethylene homopolymers as well as copolymers of ethylene with α-olefins and the term will be used without regard to the presence or absence of substituent branch groups.

Another broad grouping of polyethylene is "high pressure, low density polyethylene" (LDPE). LDPE is used to denominate branched homopolymers having densities between 0.915 and 0.930 g/cm$^3$. LDPEs typically contain long branches off the main chain (often termed "backbone") with alkyl substituents of 2 to 8 carbon atoms.

Linear Low Density Polyethylene (LLDPE) are copolymers of ethylene with alpha-olefins having densities from 0.915 to 0.940 g/cm$^3$. The α-olefin utilized is usually 1-butene, 1-hexene, or 1-octene and Ziegler-type catalysts are usually employed (although Phillips catalysts are also used to produce LLDPE having densities at the higher end of the range, and metallocene and other types of catalysts are also employed to produce other well known variations of LLDPEs). An LLDPE produced with a metallocene or constrained geometry catalyst is often referred to as "mLLDPE".

Ethylene α-olefin copolymers are copolymers having an ethylene as a major component copolymerized with one or more alpha olefins such as octene-1, hexene-, or butene-1 as a minor component. EAOs include polymers known as LLDPE, VLDPE, ULDPE, and plastomers and may be made using a variety of processes and catalysts including metallocene, single-site and constrained geometry catalysts as well as Ziegler-Natta and Phillips catalysts.

Very Low Density Polyethylene (VLDPE) which is also called "Ultra Low Density Polyethylene" (ULDPE) comprise copolymers of ethylene with α-olefins, usually 1-butene, 1-hexene or 1-octene and are recognized by those skilled in the art as having a high degree of linearity of structure with short branching rather than the long side branches characteristic of LDPE. However, VLDPEs have lower densities than LLDPEs. The densities of VLDPEs are recognized by those skilled in the art to range between 0.860 and 0.915 g/cm$^3$. Sometimes VLDPEs having a density less than 0.900 g/cm$^3$ are referred to as "plastomers".

Polyethylenes may be used alone, in blends and/or with copolymers in both monolayer and multilayer films for packaging applications "Polypropylene" is the name for a polymer whose basic structure is characterized by the chain $(C_3H_5)_n$ with several stereochemical configurations e.g. isotactic, syndiotactic and atactic in varying amounts. Polypropylene homopolymer is generally described as being a translucent solid at room temperature (RT) (~23° C.) with a density of between 0.90 to 0.91 g/cm$^3$. The relative crystallinity of polyethylene is known to affect its physical properties. The term "polypropylene" includes homopolymer as well as random and block copolymers. Copolymers of propylene have a propylene(propene) content of 60 wt. % or more, and often >80%, and most often >90% propylene. Polypropylene copolymers are typically copolymerized with ethylene, and have been produced with increased clarity, toughness and flexibility and a generally lower melting point. Randomly polymerized ethylene monomer may be added to polypropylene homopolymer to decrease polymer crystallinity and make a more transparent polymer.

As used herein, the term "modified" refers to a chemical derivative e.g. one having any form of anhydride functionality, such as anhydride of maleic acid, crotonic acid, citraconic acid, itaconic acid, fumaric acid, etc., whether grafted onto a polymer, copolymerized with a polymer, or otherwise functionally associated with one or more polymers, and is also inclusive of derivatives of such functionalities, such as acids, esters, and metal salts derived therefrom. Another example of a common modification is acrylate modified polyolefins.

As used herein, terms identifying polymers, such as e.g. "polyamide" or "polypropylene," are inclusive of not only polymers comprising repeating units derived from monomers known to polymerize to form a polymer of the named type, but are also inclusive of comonomers, as well as both unmodified and modified polymers made by e.g. derivitization of a polymer after its polymerization to add functional groups or moieties along the polymeric chain. Furthermore, terms identifying polymers are also inclusive of "blends" of such polymers. Thus, the terms "polyamide polymer" and "nylon polymer" may refer to a polyamide-containing homopolymer, a polyamide-containing copolymer or mixtures thereof.

The term "polyamide" means a high molecular weight polymer having amide linkages $(—CONH—)_n$ which occur along the molecular chain, and includes "nylon" resins which are well known polymers having a multitude of uses including utility as packaging films, bags, and pouchs.

The term "nylon" as used herein it refers more specifically to synthetic polyamides, either aliphatic or aromatic, either in crystalline, semi-crystalline, or amorphous form characterized by the presence of the amide group —CONH. It is intended to refer to both polyamides and co-polyamides.

Thus the terms "polyamide" or "nylon" encompass both polymers comprising repeating units derived from monomers, such as caprolactam, which polymerize to form a polyamide, as well as copolymers derived from the copolymerization of caprolactam with a comonomer which when polymerized alone does not result in the formation of a polyamide. Examples of such polyamides include nylon homopolymers and copolymers such as nylon 6 (polycaprolactam), nylon 6,6 (poly(hexamethylene adipamide)), nylon 6,9 (poly(hexamethylene nonanediamide)), nylon 6,10 (poly (hexamethylene sebacamide)), nylon 6,12 (poly(hexamethylene dodecanediamide)), nylon 6/12 (poly(caprolactam-co-dodecanediamide)), nylon 6,6/6 (poly(hexamethylene adipamide-co-caprolactam)), nylon 66/610 (e.g., manufactured by the condensation of mixtures of nylon 66 salts and nylon 610 salts), nylon 6/69 resins (e.g., manufactured by the condensation of epsilon-caprolactam, hexamethylenediamine and azelaic acid), nylon 11 (polyundecanolactam), nylon 12 (polylauryllactam), nylon MXDI, nylon 6I/6T, and copolymers or mixtures thereof.

In use of the term "amorphous nylon copolymer," the term "amorphous" as used herein denotes an absence of a regular three-dimensional arrangement of molecules or subunits of molecules extending over distances which are large relative to atomic dimensions. However, regularity of structure may exist on a local scale. See, "Amorphous Polymers," Encyclopedia of Polymer Science and Engineering, 2nd Ed., pp. 789-842 (J. Wiley & Sons, Inc. 1985). In particular, the term "amorphous nylon copolymer" refers to a material recognized by one skilled in the art of differential scanning calorimetry (DSC) as having no measurable melting point (less than 0.5 cal/g) or no heat of fusion as measured by DSC using ASTM 3417-83. The amorphous nylon copolymer may be manufactured by the condensation of hexamethylenediamine, terephthalic acid, and isophthalic acid according to known processes.

As used herein, "EVOH" refers to ethylene vinyl alcohol copolymer. EVOH is otherwise known as saponified or hydrolyzed ethylene vinyl acetate copolymer, and refers to a vinyl alcohol copolymer having an ethylene comonomer. EVOH is prepared by the hydrolysis (or saponification) of an ethylene-vinyl acetate copolymer. The degree of hydrolysis is preferably from about 50 to 100 mole percent, more preferably, from about 85 to 100 mole percent, and most preferably at least 97%. It is well known that to be a highly effective oxygen barrier, the hydrolysis-saponification must be nearly complete, i.e. to the extent of at least 97%. EVOH is commercially available in resin form with various percentages of ethylene and there is a direct relationship between ethylene content and melting point. For example, EVOH having an ethylene content of 38 mole % has a melting point of about 173-175° C. With increasing ethylene content the melting point is lowered, and conversely with decreasing ethylene content the melting point is raised. Also, EVOH polymers having increasing mole percentages of ethylene have greater gas permeabilities, while EVOH polymers having decreasing mole percentages of ethylene have lower gas permeabilities. A melting point of about 158° C. corresponds to an ethylene content of 48 mole %. A melting point of about 188° C. corresponds to an ethylene content of 29 mole %. EVOH copolymers having lower or higher ethylene contents may also be employed. It is expected that processability and orientation would be facilitated at higher contents; however, gas permeabilities, particularly with respect to oxygen, may become undesirably high for certain packaging applications which are sensitive to microbial growth in the presence of oxygen. Conversely lower contents may have lower gas permeabilities, but processability and orientation may be more difficult.

The term "ethylene norbornene copolymer" means an amorphous, transparent copolymer of ethylene with norbornene made by polymerization with a metallocene catalyst. It is a cyclic olefin copolymer (COC) and is commercially available from Topas in a variety of grades with varying properties. These commercially available COCs reportedly have high transparency and gloss, excellent moisture barrier and aroma barrier properties, a variable glass transition point between 65 to 178° C., high stiffness, high strength, excellent biocompatibility and inertness and are easy to extrude and thermoform.

As used herein, the term "polyester" refers to synthetic homopolymers and copolymers having ester linkages between monomer units which may be formed by condensation polymerization methods. Polymers of this type are preferable aromatic polyesters and more preferable, homopolymers and copolymers of poly(ethylene terephthalate), poly(ethylene isophthalate), poly(butylene terephthalate), poly(ethylene naphthalate) and blends thereof. Suitable aromatic polyesters may have an intrinsic viscosity between 0.60 to 1.0, preferably between 0.60 to 0.80. Processing conditions strongly influence the degree of crystallinity with limited crystallinity and small crystallites yielding excellent transparency. Crystallized PET (CPET) are opaque white in appearance due higher crystallinity and larger crytallites.

Amorphous polyethylene terephthalate (APET) typically uses an additional comonomer such as a diacid (e.g. isophthalate) or diglycol to minimize crystallinity. APET is transparent and used in a multitude of food and medical packaging including flexible bags, SUPs thermoformed trays and rigid boxes.

Glycol modified PET (PETg) utilizes a glycol comonomer such as cyclohexane dimethanol to produce a copolymerized amorphous PET having good toughness, chemical resistance, and optical properties such as high clarity, and gloss.

Oriented PET (OPET) film, sheet or articles are typically manufactured by extrusion, quenching, reheating and biaxial stretching followed by annealing to produce a stable film, sheet or article having excellent toughness and clarity as is well known in the art.

The term "plastic" as used herein means a synthetic polymer material which at some stage of its manufacture or processing can be shaped by flow and which comprises a major proportion (>50 wt. %) of at least noncellulosic polymer. Examples of plastics include without limitation organic thermoplastic or thermosetting polymers such as polyolefins, polyamides, polyesters, polystyrenes, polyurethanes, etc.

As used herein with respect to packaging films, sheets, or planar container materials including plastic materials, the term "rigid" means a material having a Gurley stiffness of at least 1000 milligrams (mg) force in each of its machine direction and transverse direction. A standard test method for determining the rigidity, stiffness values described herein is a Gurley Stiffness test, a description of which is set forth in TAPPI Standard Test T 543 and ASTM D 6125-97. A suitable testing apparatus is a Gurley Digital Stiffness Tester: Model 4171DS1N manufactured by Teledyne Gurley (514 Fulton Street, Troy, N.Y. 12181-0088). This instrument allows the testing of a wide variety of materials through the use of various lengths and widths in combination with the use of a 5, 25, 50, or 200 gram weight placed in one of three positions on the pointer of the apparatus.

According to the invention, a hermetically sealed bag containing a flowable product is loaded into a modified rigid box with attachment means such as adhesive disposed proximate to an access port to seal the bag thereto. After closing the box so that it contains the bag, the consumer or retail sized bag-in-box may be shipped to retail outlets and stored or displayed for sale on store shelves. A consumer will access the flowable or liquid product held therein by inserting communication means such as a dispensing fitment, or straw through the access port thereby piercing the bag film which is held in place against the box adjacent to the access port e.g. by adhesive. This helps to ensure a non-leaking connection. The straw or fitment may then be used to remove the contents of the bag-in-box. Although in many embodiments the access port will be located on the uppermost or top surface of the box or rigid container, it is contemplated that this port may be located on other surfaces including front, back or side wall surfaces at any desired location whether proximate the top or not. In some embodiments in may be advantageous to have a bottom access port to permit use of a gravity feed dispenser e.g. for hand lotion, soap and the like.

For the package to function properly the pouch and carton need to interact. Thus, for a puncturing device to poke through the bag or pouch effectively, in one preferred embodiment, the pouch ideally is attached to a top lid of the box or carton. This ensures the pouch stays at the top of the carton and is not pushed down away from the top with the applied force. If the pouch is not securely attached to the top lid of the carton, the pressure created, e.g. from a straw, tends to force liquid pouch contents out which creates a mess. For pre-applied attachment a registered printed wax coating or wax coated plastic film may provide good adhesion of the pouch to the carton and advantageously melt attaches at a very low temperature. For liquids packaged by a hot fill process (or by use of external heat in the downstream process) this heat may seal the pouch to the carton once the lid of the carton is closed. Wax or a very thin film coating could cover the die cut access port hole in the carton as long as it does not increase puncture resistance significantly. However, it is advantageous for the access port to be free of adhesive or to have easily removable covers to facilitate puncture opening of the bag to access the bag contents.

Another option for adhesion of bag to box is be to use hot glue or a PSA type material to adhere the pouch to the carton. The best location for the hot glue is around the perimeter of the access port hole (creating a ring) without going into the area to be punctured. Glue in the area to be punctured may undesirably increase the force needed to puncture the pouch. Alternative attachment means include glue patterns of e.g. two or more dots or stripes of glue on either side of the hole. Patterns that do not work well include attaching the pouch to the carton far away from the punctured area (as in side flaps) or on only one side of the hole. This causes the pouch to pull away from the carton or deflects the path of the straw in straw plus drink box embodiments.

In the case of a fitment, the fitment may be applied to either the box top or to the face of the inner pouch with a die cut or perforated area of the carton for the fitment to slot into or be pulled through respectively. In order to dispense a liquid without the top lid popping off, a top lid on the carton must either be attached to the pouch or the interior wall of the carton.

Graphical/Visual Enhancements

The cartons can be printed in many ways for optional specialized effects. Textured inks can create a pleasing hand feel or make the plastic carton to feel and look similar to a familiar paperboard drink box while still creating windows for viewing a liquid product. A window may also be equipped with a printed measuring device along the side, back, or front of a carton indicating to consumers the quantity remaining in either functional doses (e.g. 4, 3, 2 1), or by volume e.g. ounces or milliliters. The carton may also be printed on the inside to reveal an image through the carton as a darker contents is removed from the inner pouch.

Carton inserts may also be applied in the middle of the carton to create additional depth to images. Other types of graphical enhancements are also possible. The inner pouch could also be printed and interact with graphics on the outside of the carton. Furthermore, objects could be placed inside the pouch to float around in the liquid or placed between the pouch and carton for additional visual enhancements.

Puncturing devices such as straws, pumps, or sprayers may use a sharp end to puncture the pouch. In the case of a pump or sprayer device, the device would need to adhere to the outside of the carton. This may be accomplished by various means including e.g. the use of a liner on the top of the carton that would expose a PSA when removed.

Fitments may also be placed on the face of the pouch and not in the sealed area. The pouch film may be die cut to form a hole and a fitment sealed over the hole or alternatively a suitable fitment that cuts into the film may be employed. Fitments may be placed in the seal area and protrude from the top of the carton. A fitment attached washer may be used to connect to both pouch and box with opposing sides of the washer being sealed by fusion or adhesive to pouch and box, respectively.

Additional Optional Features

Multipacks of flowable products may be sold together with one specialized communication means such as a puncturing device (e.g. a decorative straw, pump, or sprayer). Another option is provision of a segmented carton with a flowable e.g. liquid product containing pouch in one compartment and another product which may be a nonflowable solid or other flowable product including solids or liquids, with our without a pouch, in the other compartment. For example, a liquid such as a beverage may be dispensed from one compartment and pre-wrapped food or snacks could be packaged in the other compartment. Also, one or more box edges may be beveled or recessed to: provide additional carton stability; increase comfort in holding the box by hand; provide a recess for inclusion of communication means such as a straw; and/or to round out internal box corners making it easier for the bag to conform to interior carton surfaces.

After use, the bag may conveniently be separated from the box and each component may enter a recycling stream or the materials chosen for the bag and box may be selected for single stream recycling. Advantageously, the box may collapse flat to take up less space.

Referring to the drawings, in all of the figures it will be appreciated that dimensions and relative sizes are not to scale but are chosen to illustrate the invention and its various aspects and features.

Referring now to the drawings, FIG. 1 is a schematic view of a portion of a flexible thermoplastic film web 10 having a plurality of layers 11, 12, 13, 14, 15, 16, 17, 18, 19, 20, 21, 22 and 23. Film web 10 has a first exterior surface 24 and an opposing second exterior surface 25. The film web 10 is depicted with a plurality of layers which correspond to the layers indicated in Table 1. In this embodiment of the invention, a seven layer film tubular blown film is made and the bubble is collapsed with application of heat and pressure to form a thirteen layer film web 10 useful for making a bag in accordance with the present invention. It will be appreciated that a variety of film compositions and structures may be employed in the present invention and the depicted film web 10 is exemplary only. Web 10 has a first exterior surface 24 which is the product contact surface and may be designed with desirable properties for contact with the product to be packaged, e.g. inertness, heat sealability, etc., and since in this collapsed bubble embodiment this surface is provided by layer 24 which is the same composition as distal opposing layer 11 having the same composition for second exterior surface 25, this layer 11 and surface 25 may also have suitable properties of abrasion resistance, heat sealability, etc. Other functional layers are presented as intermediate layers 12-22 and these properties may beneficially include gas barrier e.g. oxygen barrier properties such as may be provided by EVOH containing layers 14 and 20, and to a lesser extent nylon containing layers 13, 15, 19, and 21. Polyethylene containing layers including surface layers 11 and 23 as well as intermediate layers 12, 16, 17, 18, and 22 all provide water barrier properties. Each layer is also designed for good adherence to adjacent layers and layers 12, 16, 18, and 22 contain special adhesive polymers blended therein to enhance delamination resistance. The central core layer 17 has an EVA polymer with self-welding properties which promote bonding to itself in the bubble collapsing process. The entire film web structure cooperates to form a supple conformable film web 10 which will easily flex and bend to fit an interior shape of a rigid parallelepiped box as shown e.g. in FIGS. 5 and 8. Conformability may also be enhanced by filling out or pressurizing the interior of a pouch made from a conformable film. This filling out may be performed by gas flushing e.g. with nitrogen gas. The film structure is also designed to have good ability to be pierced by communication means such as a hard plastic straw or other fitment when it is attached to a box proximate an access port. The puncture resistance may be adjusted by changes to the film composition without undue experimentation e.g. the nylon layer thicknesses may be decreased to increase the ease of piercing. This particular structure is believed to seal well around the piercing site and fitment e.g. straw wall to reduce the possibility of leakage.

Figure 2:
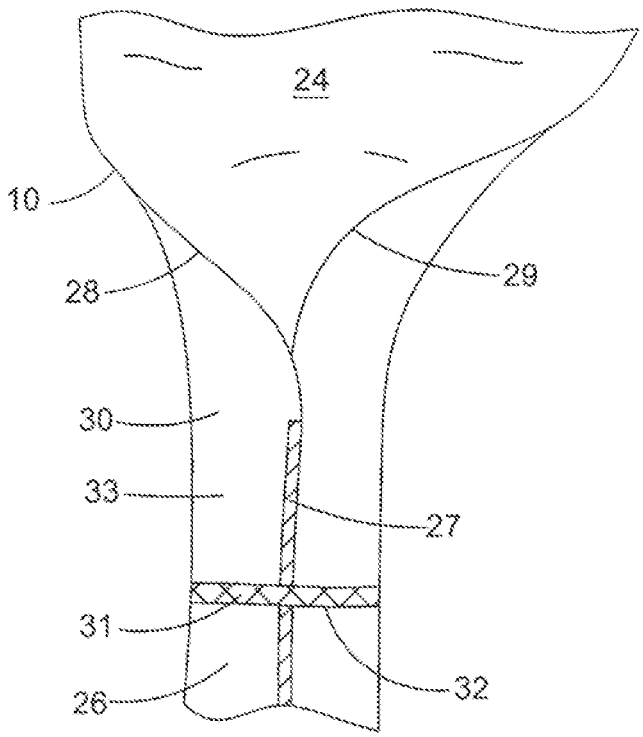
FIG. 2 is a schematic view showing formation of a flexible bag from a film web.

Referring now to FIG. 2, a schematic view shows formation of a plurality of bags including a first flexible bag 26 from film web 10, the bag film web 10 is placed on a conventional vertical form-fill-seal machine which is equipped for aseptic packaging. Web 10 is folded with first exterior surface 24 becoming the interior surface of the bag 26. Formation of a vertical lap seal 27 is depicted, although other seals such as a fin seal may be made as is known in the art. Web 10 has a first side edge 28 and opposing second side edge 29 which are made to overlap with edge 28 overlapping edge 29 a sufficient distance to permit a vertical seal 27 to be formed e.g. by application of heat and pressure, or by ultrasonic sealing means thereby forming a tube 30 which is transversely sealed by conventional means to form a first transverse seal 31. The transversely sealed tube 30 may be filled with a flowable product and a bag 26 formed by a second opposing transverse seal 32. It will be appreciated that the transverse sealing operation may provide the second closing seal 32 simultaneously with the first transverse seal 31 for a trailing second bag 33 in a continuous process and that seals 31 and 32 may be formed as a single wide seal which is longitudinally severed as part of that process to form individual bags filled with product, one of which is shown in FIG. 3.

Figure 3:
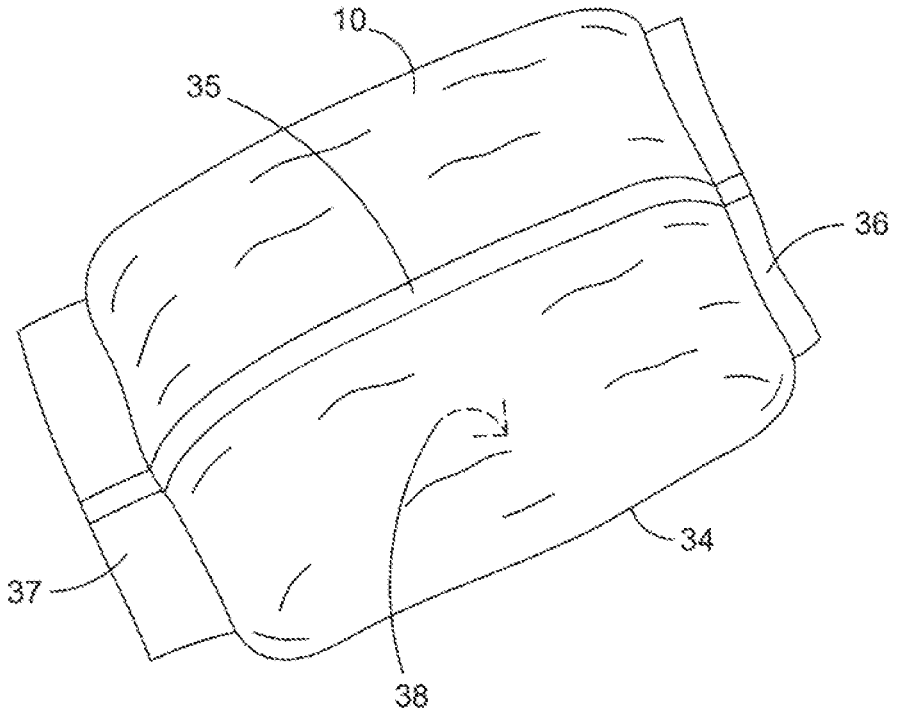
FIG. 3 is a perspective view of a bag made from a flexible film.

Referring now to FIG. 3, a perspective view of a bag 34 made from a flexible film web 10 is shown. Bag 34 is formed from film web 10 by provision of a longitudinal fin seal 35 and first and second opposing spaced apart transverse seals 36, 37. Bag 34 is filled with a product 38 such as a liquid juice beverage. Bag 34 is transparent with low haze and good clarity which allows visibility to the enclosed product 38.

Figure 4:
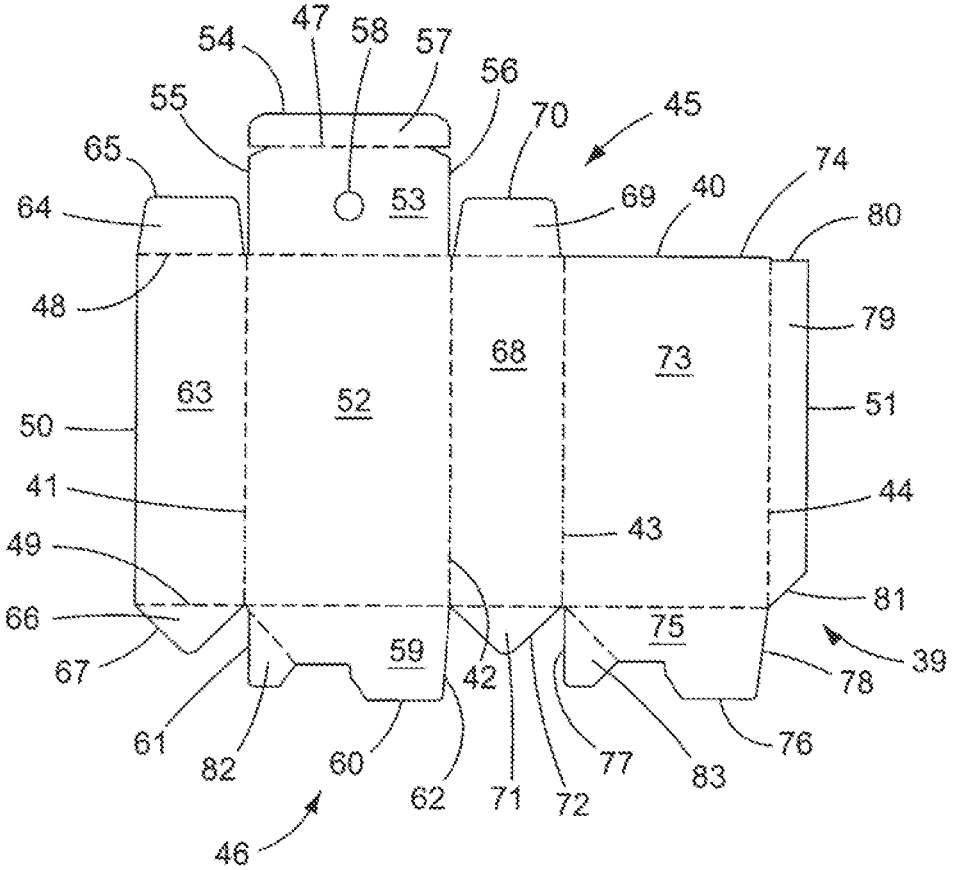
FIG. 4 is a top plan view illustrating a rigid carton blank in accordance with the present invention.

Referring now to FIG. 4, a top plan view illustrating a rigid carton blank 39, preferably of amorphous polyester (aPET) in accordance with the present invention. Carton blank 34 has a die cut perimeter edge 40 with a plurality of vertical score lines 40, 41, 42, and 43 extending from carton top 45 to carton bottom 46, and a plurality of horizontal score lines 47, 48, and 49 extending from a first carton side edge 50 to an opposing spaced apart distal second carton edge 51. These score line are also fold lines along which the blank is folded to assemble a carton into a container as shown e.g. in FIG. 5.

The vertical and horizontal score lines may be formed by ultrasonic or radio frequency soft creasing technology, see e.g. U.S. Pat. Nos. 4,064,206; 4,179,252; 4,348,449; and U.S. Pub. No. 2008/0048367, each of which are hereby incorporated by reference in their entireties. Suitable rigid boxes and box blanks are commercially available from HLP Klearfold, Torrance, Calif., U.S.A.

Referring again to FIG. 4, a back wall panel 52 is defined by vertical score lines 41, 42 and horizontal score lines 48 and 49. Integrally connected to the back wall panel 52 at score/fold line 48 is top panel 53 which is defined by score line 48, top edge 54, first top panel side edge 55 and second top panel side edge 56. A portion of the top panel between the top edge 54 and score line 47 forms a top fold tab 57 which is adapted to be folded about score/fold line 47 to close the carton after assembly into a box and loading with a product filled bag as further described below. Top panel 53 is provided with an access port shown as hole 58. Also, integrally connected to the back wall panel 52 at score/fold line 49 is first bottom panel 59 which is defined by score line 49, back panel bottom edge 60, first back bottom panel side edge 61 and second back bottom panel side edge 62.

Integrally connected to the back wall panel 52 at vertical score/fold line 41 is a first side wall panel 63 which is defined by score lines 41, 48, and 49 and first carton side edge 50. Integrally connected to the first side wall panel 63 at score/fold line 48 is first side wall panel top flap 64 having an inverted "U" shaped first side wall panel top flap edge 65. Integrally connected to the first side wall panel 63 at score/fold line 49 is first side wall panel bottom flap 66 having a "V" shaped first side wall panel bottom flap edge 67.

Integrally connected to the back wall panel 52 at vertical score/fold line 42 is a second side wall panel 68 which is defined by spaced apart vertical score/fold lines 42, 43 and spaced apart horizontal score/fold lines 48, 49. Integrally connected to the second side wall panel 68 at score/fold line 48 is second side wall panel top flap 69 having an inverted "U" shaped second side wall panel top flap edge 70. Integrally connected to the second side wall panel 68 at score/fold line 49 is second side wall panel bottom flap 71 having a "V" shaped second side wall panel bottom flap edge 72.

Integrally connected to the second side wall panel 68 at vertical score/fold line 43 is a front panel 73 which is defined by spaced apart vertical score/fold lines 43, 44, horizontal score/fold line 49 and spaced apart front panel top edge 74. Integrally connected to the front panel at score/fold line 49 is second bottom panel 75 which is defined by score line 49, second bottom panel bottom edge 76, first front bottom panel side edge 77, and second front bottom panel side edge 78. In addition, integrally connected to front wall panel 73 at score/fold line 44 is a side connecting flap 79 defined by score/fold line 44, spaced second carton side edge 51, top side flap edge 80 and spaced apart bottom side flap slant edge 81.

Figure 5:
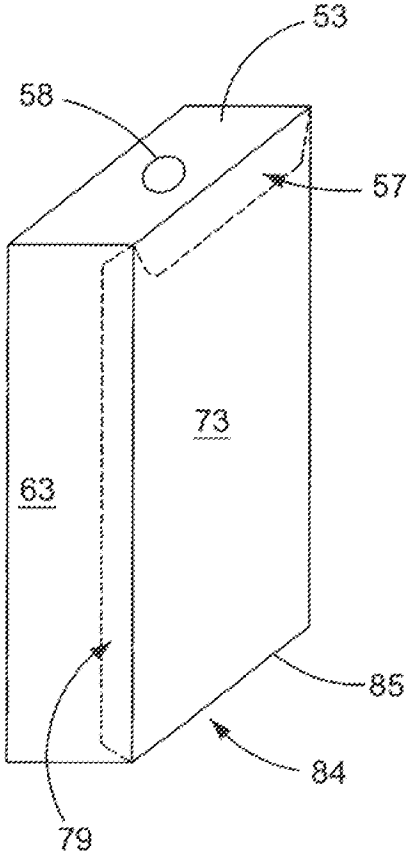
FIG. 5 is a perspective view illustrating the carton of FIG. 4 assembled into a parallelepiped container in accordance with the present invention.

To assemble the carton blank 39 into a box as shown in FIG. 5, The vertical score/fold lines permit folding of the first side wall panel 63, the back wall panel 52, the second side wall panel 68, the front wall panel 73 and side flap 79 to construct a tube of rectangular cross-section with the side flap 70 disposed interiorly and sealed proximate to first carton side edge 50 from an area proximate to horizontal fold line 48 to an area proximate horizontal fold line 49 e.g. by application of an adhesive (preferably one that sets with a high degree of transparency). The first bottom panel 59 and second bottom panel 75 are designed to cooperate to form an interlocking bottom which is adapted to support contents within the assembled box (See FIG. 5). First bottom panel 59 is equipped with a connecting tab 82 which is sealed, e.g. by adhesive, to first side wall panel bottom flap and second bottom panel 75 is similarly equipped with a connecting tab 83 which is similarly sealed, e.g. by adhesive, but to second side wall panel bottom flap 71 and by provision of these seals and the sealing of the side connecting flap as previously disclosed, the carton box may be stored in a flat condition ready for assembling into a free standing self-supporting rigid box as seen in FIG. 5. When the flattened box bottom is along score/fold line 49 is forced (either manually or by packaging machinery) into a rectangular configuration, the first and second bottom panels snap together to form a rigid base which maintains the box configuration. Lay flat folding plastic folding boxes of this construction, but without access ports, are commercially available from HLP Klearfold. An alternative lay flat folding base is presented in U.S. Pat. Nos. 5,458,233 and 5,499,484 each of which is hereby incorporated by reference in their entireties.

Referring now to FIG. 5, a perspective view illustrating the carton blank 39 of FIG. 4 assembled into a parallelepiped container box 84 in accordance with the present invention is shown. Box 84 has a flat base 85 with a continuous upstanding rigid wall with front wall panel 73 and first side wall panel 63 shown with side connecting flap 79 adhesively sealing together panels 63 and 73. A bag such as that shown in FIG. 3 which is filled with a flowable, preferably liquid, product is loaded into box 84 and top panel 53 having an access port such as hole 58, is closed to hold the bag within the box 84. Prior to closing the top panel, adhesive is applied around the hole 58 on the top panel as well as on top fold tab 57 so that the tab 57 may be sealed to an inside surface of the front wall panel 73 and tab 57 proximate hole 58 may be sealed to the bag contained within the box 84.

Figure 6:
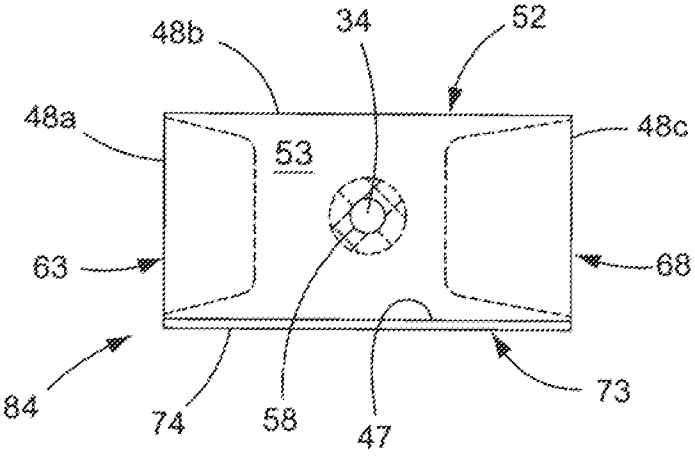
FIG. 6 is a top plan view of the container of FIG. 5 in accordance with the present invention.

Referring now to FIG. 6, a top plan view of the container box 84 of FIG. 5 in accordance with the present invention is shown. Box 84 has a top panel 53 with hole 58 for providing an access port to interiorly disposed bag 34 which is adhesively attached to an interior surface of the top panel 53. Top panel 53 has a box top perimeter 86 defined by fold lines 47, 48*a*, 48*b*, and 48*c*. Also, locations are indicated for the front wall panel 73, and rear wall panel 52, connected by spaced apart first and second side wall panels 63, and 68.

Figure 7:
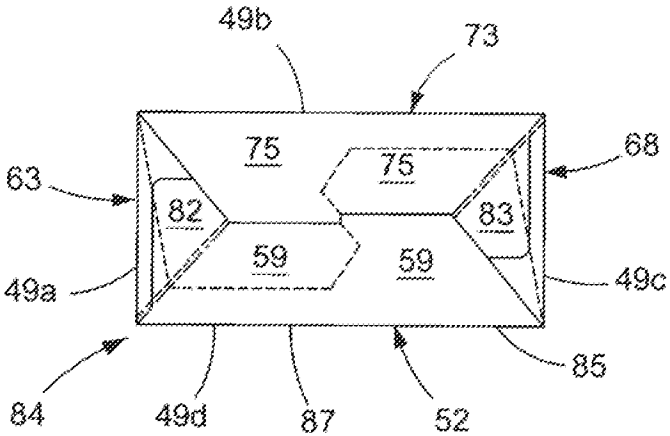
FIG. 7 is an bottom plan view of the container of FIG. 5.

Referring now to FIG. 7, a bottom plan view of the container box 84 of FIG. 5. Locations are indicated for the front wall panel 73, and rear wall panel 52, connected by spaced apart first and second side wall panels 63, and 68. A flat bottom base 85 has a boundary that is defined by base perimeter 87 formed by score/fold lines 49*a*, 49*b*, 49*c*, and 49*d*. The first bottom panel 59 having connecting tab 82 interlocks with the second bottom panel 75 having connecting tab 83 to form the flat bottom base 85 in the assembled box 84.

Figure 8:
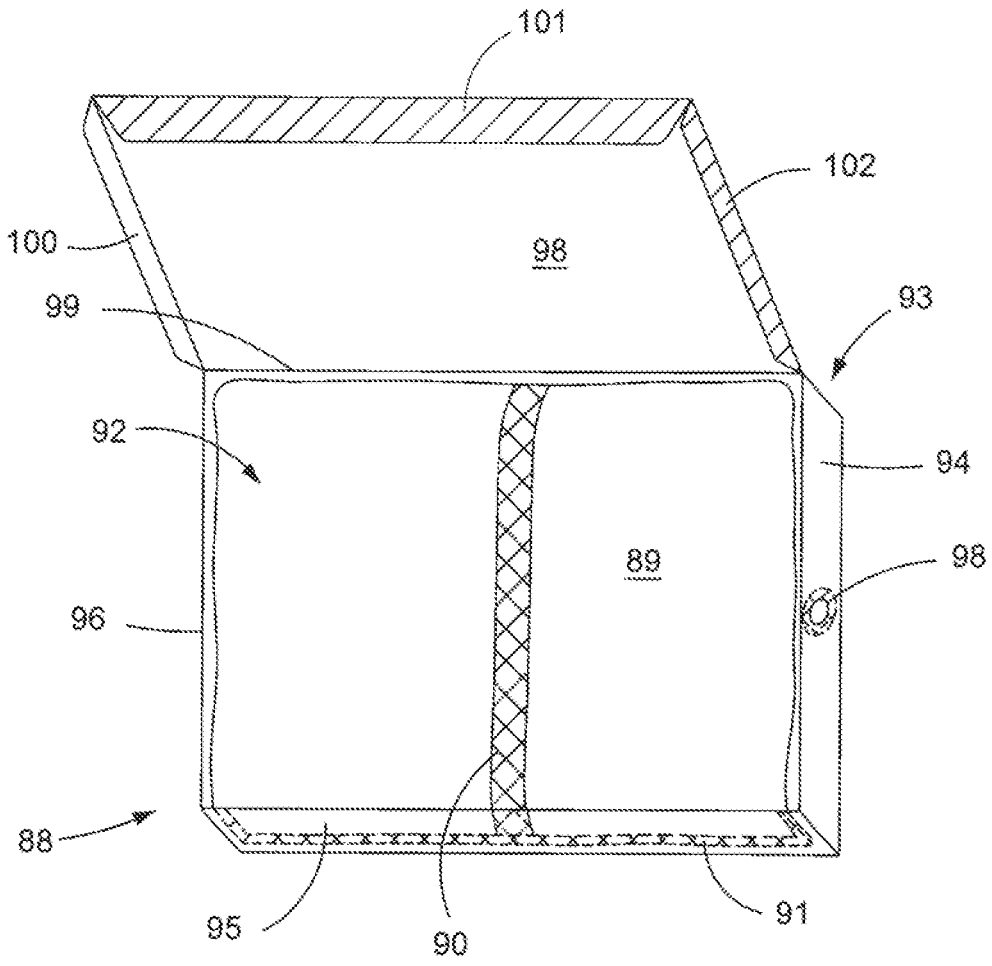
FIG. 8 a perspective view of an alternative embodiment of the invention showing an open transparent box container holding a filled transparent bag.

Referring now to FIG. 8, a perspective view of an alternative embodiment of the invention showing an open transparent box 88 holding a filled transparent bag 89 having a fin seal 90 and transverse seal 91. In this embodiment, a compartment 92 is formed in box 88 by a back wall (not shown) connected by a first side wall 93, top wall 94, second side wall 95, and bottom wall 96. The bag 89 is sealed to an interior surface of top wall 94 adjacent to an access port 97 which may be a hole or other opening. The transparent bag is enclosed within the transparent box 88 by closing a front wall 98 which is attached to the first side wall 93 by a hinge formed from score/fold line 99. Front wall 98 has three tabs 100, 101, and 102 which are sealed e.g. by a transparent adhesive to interior surfaces of the bottom, second side, and top walls 96, 95, and 94, respectively. Once closed and sealed shut, the box may be positioned top side down to permit gravity to hold the bag 89 against the interior of top 94 adjacent access port 98 thereby ensuring a good adhesive contact between bag film and box until the adhesive sets. For display, the box 88 may be positioned with its bottom wall 96 down upon a display shelve with the top wall positioned uppermost relative to a potential purchaser or user and the front wall facing a store aisle for display of any product information and/or designs thereon while having at least a portion of the upstanding rigid wall transparent to allow the potential customer or user to see the product, its appearance, color, and texture (if any), as well as its volume level within the closed package. Advantageously, in use the amount of product remaining may be easily determined which can be useful for non-single serve products such as soap, skin lotion, soup broth, etc. which may not be entirely consumed in a single use.

Figure 11:
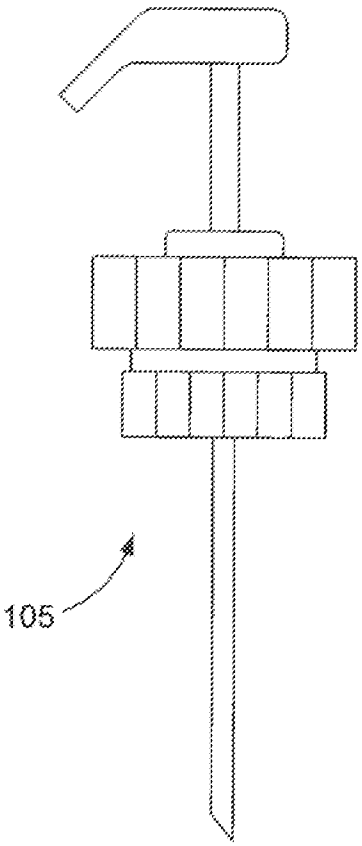
FIG. 11 is a schematic view of a pump fitment adapted for attachment at an access port.
Figure 10:
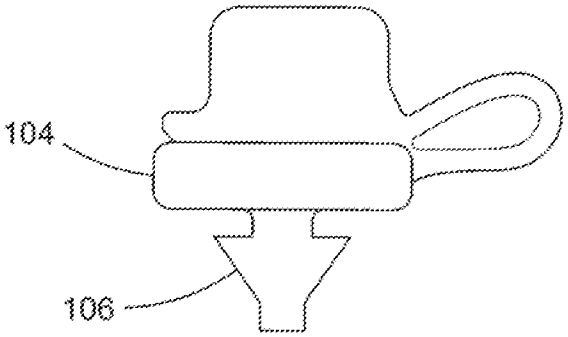
FIG. 10 is a schematic view of a fitment adapted for attachment at an access port.
Figure 9:
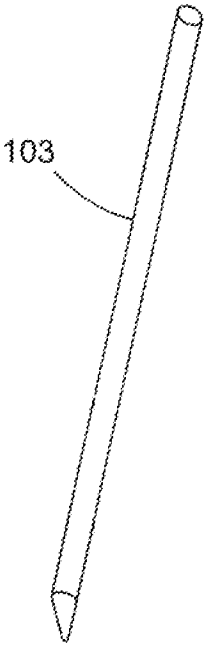
FIG. 9 is a perspective view of a plastic straw.

Referring now to FIGS. 9-11, a series of drawings depicting various fitments and communication means including a perspective view of a rigid plastic straw 103, a schematic view of a snap cap fitment 104 adapted for attachment at an access port, a schematic view of a pump fitment 105 adapted for attachment at an access port. Each of these fitments may be equipped with means for attachment to the box e.g. by piercing the bag through the access port using a sharp or pointed fitment end. Straw 103 may be held by friction within the opening made by piercing and easily adjusted manually without undesirable leakage. Snap cap 104 may be held in place by a barb design having a flared end 106, and pump 105 may be provided with a screw or twist lock mechanism which screws into or locks into a mating fitment which may be provided on the box at the access port to provide communication means. These fitments and communication means are exemplary only and in view of the present disclosure those skilled in the art will understand that a great variety of communications means may be employed with the present invention. Examples of other contemplated communication means include such fitments as trigger sprayers, screw caps, metering or measuring dispensers, and any known means may be provided as desired. The inventive package may also be equipped with or without tamper evident features or freshness indicators as desired. For example, a die cut and perforated overhanging tab may be built into a package surface to provide access to a fitment or reveal an access port. Such a tab could be totally or partially removable and may create a sound when opening by provision of discrete points of attachment e.g. by perforations which are broken upon manual removal by peeling along spaced apart perforated lines.

The invention may also utilize rigid boxes in a variety of shapes. Although a parallelepiped shape is preferred, a horizontal cross-section of the box may be a trapezoid, parallelogram, triangle, hexagon, or polygon of various designs as well as include one or more curved walls e.g. an oval or circular shape. Furthermore, although more challenging to make and fill the rigid box may approximate an hourglass shape or have indented curved, tapered, or stepped in portions. Advantageously, in preferred embodiments it is desired that the shape maximize packing for shipping cartons and display. The bottom should enable the rigid box to sit stable upon a flat shelf and be self-supporting without leaning on any adjacent external display support member or wall typically the bottom panel will be flat, but it may also be a recessed panel with a bottom rim having an supporting edge which lies within a plane to permit stable support on a flat surface. Although less critical for the top, a flat top panel is preferred to maximize product delivery in case lots, and to provide support for stacking multiple layers of boxes in a shipping carton or on a display shelf. Alternatively the top panel may be peaked, curved, at an angle, or other than flat, to provide consumer interest, etc.

It will also be appreciated that once a portion of the product is removed from the bag-in-box, it may reveal a design or message and that a bag wall or box surface distal from the viewer may be printed with indicia to provide any desired information including e.g. reminders, instructions, warnings, or branding, etc.

The present invention advantageously provides clarity enabling consumers and users to see the product being dispensed or consumed. Traditional liquid box packaging, e.g. drink boxes such as the Tetra Brik brand boxes are made with paper and foil and are opaque and without visibility to their contents.

The present invention may also be advantageously used in place of non-collapsible rigid containers e.g. thermoformed tubs, bottles, metal and rigid plastic cans, and the like. These prior art containers are bulky to ship and store prior to filling with contents. In contrast, in the present invention the boxes may conveniently be shipped and stored flat and expanded to a stable non-collapsible state when desired for insertion of filled bags.

The bag-in-box design provides a rigid transparent carton box which boosts user confidence compared to handling liquid pouches. The user is less nervous about spilling or inadvertently causing liquids to exit the flexible bag in an unwanted and undesired fashion. At the same time the rigid box has better aesthetics than a stand up pouch, the visual presentation may use billboard type graphics on an easy to see surface undeformed by wrinkles and beneficially permits visual access to the color and appearance of the enclosed product while opening up other possibilities for conveyance of messaging words and designs e.g. by having revealable messages which are contained in a back and/or side surface that comes into view after removal, consumption and/or use of a nontransparent or obscuring product. This may appeal to children who are amused or enlightened by cartoons, puzzles or fun facts that come into view e.g. as the child consumes grape juice or milk. The rigid box also facilitates stackability for shipping and retail display and may incorporate tamper resistant and tamper evident features. Advantageously, the bag and box may be made separable with the rigid box (which typically has the majority of the package weight) being recyclable. The separated bag and box each easily collapses flat to reduce space required for disposal and/or recycling. In use the bag may also collapse as product is removed reducing contact with oxygen and offering the potential for a longer product life without oxidative deterioration. The communication means may be made reuseable so that it may be removed from an empty bag-in-box and inserted into a new full container e.g. for liquid soaps or household cleaners.

Bag Construction

In the present invention a thermoplastic, at least partially translucent, and preferably transparent, bag is provided in an at least partially translucent, and preferably transparent box. The terms "bag" and "pouch" are used interchangeably. A variety of known thermoplastic bag constructions may be used with the present invention depending upon the product to be packaged and the functional requirements for the intended product and use. It is essential that at least 10% of the surface area of the bag and of the box provide visual access to the inside of the bag. It is believed that a quad-seal bag having an attached fitment communication means suitable for use in the present invention may be made by adapting a Bossar Vertical Horizontal machine to produce a bag in accordance with the teachings herein. The Bossar machine is available from Bossar Packaging, Barcelona, Spain.

Film Thickness

The packaging films for the bag construction will suitably have a total thickness of less than about 10 mils, and beneficially a total thickness of from about 1.0 to 10 mils (25-250 microns (μ)). Preferred embodiments may have a thickness from about 1 to 5 mils, with certain typical embodiments being from about 1.75 to 3.5 mils. For example, the entire bag film can have any suitable thicknesses, including 1, 2, 3, 4, or 5 mils, or any increment of 0.1 or 0.01 mil therebetween. Although suitable bag films for packaging, e.g. beverages, as thick as 5 mils (127 microns) or higher, or as thin as 1 mil (25.4 microns) or less may be made, it is expected that the most common films will be between about 2.5-3.5 mil (63.5-88.9 microns). Such films may have good abuse resistance and machinability and especially good conformability to the interior surface of the rigid container for an attractive visual appearance and maximization of utilization of the interior box volume or space. Films over 5 mil in thickness will become less conformable to the box interior especially at corners and intersections of walls disposed at 90° to one another.

Film Layers

The bag may be a monolayer or a multilayer construction. Films of 1, 2, 3, 4, 5, 6, 7, 8, 9, 10, 11, 12, 13, 14, 15, 16, 17, 18 or more layers are contemplated for the bag. For some flowable products, a monolayer film of e.g. a polyolefin such as polyethylene or polyproylene, LLDPE, or EVA, or a blend of polyolefins may be used. For other products, performance requirements may be satisfied by a two or three layer film e.g. by coupling PET with a heat sealable layer of polyolefin, or by placing an oxygen and moisture barrier polymer such as PVDC between a heat seal layer of polyolefin and an abuse resistant layer of another polyolefin. In applications for which higher performance or specific properties are desired even more layers may be used. If multilayer, one or more layers may be employed in the bag construction to provide the desired functionality. Alternatively, or additionally, polymers may be selected and blended to provide a layer with multiple functions in either monolayer or multilayer embodiments. Often multiple layers are utilized to provide specific functionality to the bag, although any single layer may have adequate properties for multiple functionalities.

Therefore, one or more functional properties may be contributed by one or more layers including desired levels of heat sealability, optical properties e.g. transparency, gloss, haze, abrasion resistance, coefficient of friction, tensile strength, flex crack resistance, puncture resistance, controlled rupture, abrasion resistance, printability, colorfastness, flexibility, dimensional stability, barrier properties to gases such as oxygen, or to moisture, light of broad or narrow spectrum including e.g. uv resistance, etc.

Thus, the inventive package may use films that may include additional layers or polymers to add or modify various properties of the desired film such as heat sealability, interlayer adhesion, wrinkle resistance, flexibility, conformability, puncture resistance, printability, toughness, aroma barrier, gas and/or water barrier properties, abrasion resistance, printability, and optical properties such as clarity, transparency, haze, gloss, color, reflectivity, iridescence, luminescence, freedom from lines, streaks or gels. These layers may be formed by any suitable method including coextrusion, extrusion coating and lamination. Various types of exemplary functions and layers are described below.

Article Contact/Heat Sealing Layers

Every bag will have an article contact layer. This layer is often designed to also be heat sealable since heat sealing is a convenient and secure way of forming and sealing a hermetic package. Other means of sealing such as by use of adhesives or mechanical means e.g. clips may be used instead of heat sealing or in addition thereto. A variety of article contact/heat seal layers may be employed with the present invention and these may include, without limitation, polyolefins such as polypropylene or polyethylene, PVC, polychlorotrifluoroethylene coated PVC, acrylonitrile polymers, etc. In certain embodiments where anti-scalping properties are desired, it is preferable that the article contact layer contain a chemically inert material having antiscalping properties such as PET, polyacrylonitrile, or a cyclic olefin copolymer (COC) such as ethylene norbornene copolymer. The contact layer may also function as a heat sealing or heat sealable layer to facilitate formation of hermetically sealed packages.

Barrier Layers

A primary function of packaging is to provide a barrier against various undesirable physical, chemical or biological contaminants or forces. Often specialized layers are provided for enhanced effectiveness against particular deleterious phenomena. Thus, a specialized barrier layer may function both as a highly effective gas barrier layer, and as a moisture barrier layer, although these functions may be provided by separate layers. The gas barrier layer is typically an oxygen barrier layer since oxygen often has detrimental effects on shelf life and for certain items taste or odor. Frequently, an oxygen barrier is a core layer positioned between and protected by surface layers. For example, the oxygen barrier layer can be in contact with a first surface layer and an adhesive layer or may be sandwiched between two tie layers and/or two surface layers.

In accordance with the present invention, the inventive packaging film may utilize a gas barrier layer utilizing materials such as polyvinylidene chloride copolymers such as saran, or ethylene vinyl alcohol copolymers which provide high barriers to gas permeability. An oxygen barrier material is preferably selected to provide an oxygen permeability sufficiently diminished to protect the packaged article from undesirable deterioration or oxidative processes. A reduced oxygen permeability helps prevent or delay oxidation of oxygen sensitive articles and substances to be packaged in the film. For packaging oxygen sensitive products, it is desirable that the films of the present invention have an oxygen barrier transmission rate ($O_2TR$) of less than or equal to 20 (more desirably ≤10) $cm^3/100\ in^2$ per 24 hours at 1 atmosphere, 23° C. and 0% relative humidity (RH).

Advantageously, a multilayer packaging film in accordance with the present invention for packaging many oxygen sensitive products for aseptic, hot fill and/or retort applications will have an oxygen barrier transmission rate ($O_2$TR) of less than or equal to 10 (more preferably ≤0.5) g/100 in$^2$ per 24 hours at 1 atmosphere, 23° C. and 0% relative humidity (RH).

In accordance with the present invention, the inventive packaging film may utilize a moisture barrier layer such as polyvinylidene chloride copolymers such as saran, or polyolefin materials such as LDPE which impede moisture vapor permeation. A water or moisture barrier is preferably selected to provide a moisture permeability sufficiently diminished to protect the packaged article from undesirable deterioration and/or retain liquid articles without alteration of composition or loss of moisture or water content. Moisture barriers are also used to protect the functionality of other packaging materials which may be water sensitive. For example, a film may comprise an water barrier having an moisture permeability that is low enough to prevent weight loss of water by permeation through the film. It may also act to prevent undesirable interaction with contained product which may be e.g. hygroscopic in nature. In addition, it may protect a material such as EVOH which is often used as an oxygen barrier but whose oxygen properties deteriorate in the presence of water.

It is desirable that the films of the present invention have a water vapor transmission rate (WVTR) of less than 0.5 g/100 inch$^2$ per 24 hours at 100° F. and 90% relative humidity (R.H.).

In many embodiments of the present invention, suitable barrier properties may have values of WVTR less than or equal to 0.03 g/100 in$^2$/24 hours at 1 atmosphere at 100° F. (38° C.) and 90% R.H.; and/or $O_2$TR values of less than or equal to 10 cm$^3$/100 in$^2$/24 hours at 1 atmosphere at RT and 0% R.H. Preferred barrier property values are WVTR≤0.001 g/100 in$^2$/24 hours (≤0.0155 g/meter$^2$/24 hours) at 1 atmosphere at 100° F. (38° C.) and 90% R.H., and/or $O_2$TR values of less than or equal to 1.0 (and more preferably ≤0.5) cm$^3$/100 in$^2$/24 hours at 1 atmosphere, RT and 0% R.H.

The oxygen and moisture barrier layer(s) may comprise any suitable material which does not undesirably impair the required transparency of the film. An oxygen barrier layer can comprise EVOH, polyvinylidene chloride, polyamide, polyester, polyalkylene carbonate, polyacrylonitrile, etc., as known to those of skill in the art. Suitable moisture barrier layers include polyolefins such as LDPE, MDPE, HDPE, PP, or LLDPE, as well as PCTFE, and PVDC.

A common oxygen and moisture barrier that is unsuitable for the present invention is metal foil such as aluminum foil whose opacity destroys a chief aim of the present invention which is to permit viewing of the contained product. Therefore the inventive package may be free of metal foils such as aluminum. However, certain embodiments of the invention may use metal foils on a limited portion of the packaging bag and/or box for decorative or functional purposes including as an oxygen and/or moisture barrier layer as long as neither the entire bag nor entire box is covered by opaque metal foil thereby preventing sight of at least a portion of the contained product. It is essential that the inventive bag-in-box provide visual access to at least a portion of the bag contents.

It is desirable that the thickness of the barrier layer(s) be selected to provide the desired combination of the performance properties sought e.g. with respect to oxygen permeability, and water barrier properties. Suitable thicknesses in multilayer films for a polymeric $O_2$ barrier are typically less than 15%, e.g. from 3 to 13% of the total film thickness and preferably less than about 10% of the total thickness of the multilayer film. Greater thicknesses may be employed however oxygen barrier polymers such as EVOH tend to be relatively expensive and therefore it is expected that less costly materials will be used in other layers to impart desirable properties once a suitable thickness is used to achieve the desired gas barrier property for the film layer combination. For example, the thickness of a core oxygen barrier layer may advantageously be less than about 0.45 mil (10.16 microns) and greater than about 0.05 mil (1.27 microns), including e.g. 0.10, 0.20, 0.25, 0.30, 0.40, or 0.45 mil thick. Thus, the thickness of this $O_2$ barrier core layer may be varied and beneficially may be from about 0.05 to about 0.60 mils (1.3-15.2 microns). Thinner or thicker oxygen barrier layers or multiple layers may be used as well to achieve the desired barrier properties.

The oxygen barrier layer of a film may advantageously comprise EVOH, although oxygen barrier layers comprising polyvinylidene chloride-vinyl chloride copolymer (PVDC or VDC-VC) or vinylidene chloride-methylacrylate copolymer (VDC-MA) as well as blends thereof, can also be used as may other known transparent or translucent oxygen barrier materials. One suitable EVOH barrier material is a 38 mol % EVOH resin sold by Nippon Gohsei under the trade name Soarnol® ET3803. Another example of an EVOH that may be acceptable can be purchased from Nippon Gohsei under the trade name Soarnol® DT2904 (29 mol % ethylene).

Bulk Layers

A bulk layer may be provided to provide additional functionality such as stiffness or heat sealability or to improve machinability, cost, flexibility, barrier properties, etc. Preferred bulk layers comprise one or more polyolefins such as polyethylene, ethylene-alpha olefin copolymers (EAO), polypropylene, polybutene, ethylene copolymers having a majority amount by weight of ethylene polymerized with a lesser amount of a comonomer such as vinyl acetate, and other polymeric resins falling in the "olefin" family classification. The bulk layer may be of any suitable thickness from 0.1 to 7 mils or may even be omitted for use in certain applications, but is preferably present to improve especially stiffness/flexibility properties and heat sealability.

Abuse-Resistant Outer Layer

Since all embodiments of the invention require at least a portion of the film to be translucent or transparent, the film should enhance optical properties and preferably has high transparency, high clarity and low haze. Also, it should provide abrasion and puncture resistance, and for these reasons it is often termed the abuse-resistant layer. As the exterior surface layer of the film, this layer is also the exterior layer of a bag or other container made from the film, and is therefore subject to handling and abuse e.g. from equipment during packaging, and from rubbing against other packages and box interior walls, not only in the packaging process, but also during transport, storage, display and use. Surface contact with abrasive forces, stresses and pressures may abrade the film, causing defects which may diminish optical characteristics or cause punctures or breaches in the integrity of the package. Therefore the exterior surface layer is made from materials chosen to be resistant to abrasive and puncture forces and other stresses and abuse which the packaging may encounter during packaging, shipping, and use. The exterior surface layer should be easy to machine (i.e. be easy to feed through and be manipulated by machines e.g. for conveying, packaging, printing or as part of the film or bag manufacturing process). Suitable stiffness, flexibility, flex crack resistance, modulus, tensile strength, coefficient of friction, printability, and optical properties are also designed into exterior layers by suitable choice of materials. This layer may also be chosen to have characteristics suitable for creating desired heat seals which may be heat resistance to burn through e.g. by impulse sealers or may be used as a heat sealing surface in certain package embodiments e.g. using overlap seals. For high clarity, a preferred exterior layer comprises an amorphous polyester such as APET or PETG.

The exterior surface layer thickness is typically 0.2 to 2.0 mils. Thinner layers may be less effective for abuse resistance, but may have increased conformability. Thicker layers, be used to produce films having unique highly desirable abuse resistance properties, but may be more expensive and have less conformability.

Intermediate Layers

An intermediate layer is any layer between the exterior layer and the interior layer of the bag film and may include specialized barrier layers; tie layers; or layers having functional attributes useful for the film structure or its intended uses. Intermediate layers may be used to improve, impart or otherwise modify a multitude of characteristics: e.g. printability for trap printed structures, machinability, tensile properties, flexibility, stiffness, modulus, designed delamination, tear properties, strength, elongation, optical, moisture barrier, oxygen or other gas barrier, radiation selection or barrier e.g to ultraviolet (UV) wavelengths, etc. Suitable intermediate layers may include: adhesives, adhesive polymers, polyolefin, oriented polyester, amorphous polyester, polyamide, nylon, or copolymers, blends or derivatives thereof, as well as metal foils e.g. a pouch may be made by sealing together: (i) a back web having an opaque reflective metal foil to (ii) a transparent, metal foil free front web). Suitable polyolefins may include: polyethylene, ethylene-alpha olefin copolymers (EAO), polypropylene, ethylene copolymers having a majority amount by weight of ethylene polymerized with a lesser amount of a comonomer such as vinyl acetate, and other polymeric resins falling in the "olefin" family classification, LDPE, HDPE, LLDPE, EAO, ionomer, EMA, EAA, modified polyolefins e.g. anhydride grafted ethylene polymers, etc.

Tie Layers

One type of intermediate layer is an adhesive layer, also known in the art as "tie layer," which can be selected to promote the adherence of adjacent layers to one another in a multilayer film and prevent undesirable delamination. A multifunctional tie layer may be formulated to aid in the adherence of one layer to another layer without the need of using separate specialty adhesives by virtue of the compatibility of the materials in the tie layer to the adjacent "tied" first and second layers. In some embodiments, adhesive tie layers comprise materials found in both the first and second tied layers. In other embodiments, specialty adhesive resins, such as anhydride modified polyolefins, are required, either alone or in blends with other polymers. The adhesive layer may suitably be less than 10% and preferably between 2% and 10% of the overall thickness of the multilayer film. Adhesive resins are often more expensive than other polymers so the tie layer thickness is usually kept to a minimum consistent with the desired effect. In one embodiment, a multilayer film comprises a structure having a first adhesive layer positioned between and in direct contact with the exterior layer and a core oxygen barrier layer; and preferably and optionally has a second tie layer between and in direct contact with the opposite side of the same core oxygen barrier layer and the interior layer to produce a five layer film. Adhesive layers may include modified e.g. anhydride modified polymers e.g. polyolefins such as polyethylenes or ethylene copolymers such as EVA and may also be primers or specialty adhesive resins.

Multilayer films can comprise any suitable number of tie or adhesive layers of any suitable composition. Various adhesive layers are formulated and positioned to provide a desired level of adhesive between specific layers of the film according to the composition of the layers contacted by the tie layers.

The exterior, interior, intermediate or tie layers of the bag film may be formed of any suitable plastic materials, for example, polyolefins, and in particular members of the polyethylene family such as LLDPE, VLDPE, HDPE, LDPE, ethylene vinyl ester copolymer or ethylene alkyl acrylate copolymer, polypropylenes, ethylene-propylene copolymers, ionomers, polybutylenes, alpha-olefin polymers, polyamides, nylons, polystyrenes, styrenic copolymers e.g. styrene-butadiene copolymer, polyesters, polyurethanes, polyacrylamides, anhydride-modified polymers, acrylate-modified polymers, polylactic acid polymers, cyclic olefin copolymers, or various blends of two or more of these materials.

Optional Additives to Layers

Various additives may be included in the polymers utilized in one or more of the exterior, interior and intermediate or tie layers of packaging comprising the same. Additives and processing aides; natural and synthetic colorants, pigments and dyes; and antimicrobial agents may be incorporated into or coated on one or more layers of the multilayer films of the present invention. Thus, conventional antioxidants; antiblock additives; plasticizers; acid, moisture or gas (such as oxygen) scavengers; slip agents; colorants; dyes; pigments; organoleptic agents; antimicrobial agents; and mixtures thereof may be added to one or more film layers of the film or individual layers or the entire film may be free from such added ingredients. It is highly desirable that the bag film be made of materials which do not impair the desired transparency, although portions of the bag film may advantageously be opaque to provide attractive colors, designs, printing, product information, instructions, etc. It is essential that at least a portion of the bag film be transparent to provide visual access between the exterior environment of an observer and the bag contents. Additives and processing aides are typically used in amounts less than 10%, frequently less than 7%, and preferably less than 5% of the layer weight. Slip agents may include one or more of fluoroelastomers, stearamides, erucamides, and silicates.

Preferred films may also provide a beneficial combination of one or more or all of the properties including low haze, high clarity and transparency, good machinability, suppleness and conformability, good mechanical strength and good barrier properties including high barriers to oxygen and water permeability. Preferred films may also have good compression strength when subjected to loads from stacking multiple layers, and provide burst resistance when subjected to shocks e.g. by dropping. Preferred films have a haze of less than 50%, preferably less than 25% and advantageously less than 15%.

Unless specifically noted, the polymers defined herein are "unmodified" by any intentional grafting or copolymerization with modifying moieties such as dienes, rubber moieties or acrylic acids. However, the polymers may contain chemicals or additives in small amounts (typically under 1% by weight based on the weight of the polymer) which are present as by-products of the polymer manufacturing process or otherwise added by polymer manufacturers including e.g. catalyst residues, antioxidants, stabilizers, antiblock materials and the like.

Methods of Manufacture

The multilayer bag film may be made by conventional processes. These processes to produce flexible films may include e.g. cast or blown film processes, coating lamination, adhesive lamination and conventional forming, sealing and/or cutting operations.

Box Construction

In the present invention, an at least partially translucent, and preferably highly transparent, rigid box is provided. This box is attached to and contains an at least partially translucent, and preferably highly transparent bag. It is essential that at least 10% of the surface area of the box provide visual access to the box interior, and preferably at least 10% of the box side wall. In various embodiments, the area of visual access through the box and/or bag will be at least 20%, at least 30%, at least 40%, at least 50% or higher. It is critical that at least a portion of the bag have a translucent, and preferably transparent, wall which overlaps a translucent, and preferably transparent, portion of the box wall to provide visual access to a product contained within the bag, and that area of overlapping visual access is preferably at least 10% of the box surface, and more preferably at least 10% of the box side surface. Advantageously, in certain embodiments, this visual access through both bag and box will be at least 20%, at least 30%, at least 40%, at least 50% or more of the box side surface. Preferred box walls have in their translucent or transparent portion a haze of less than 50%, preferably less than 25% and advantageously less than 15% and most desirably less than 7%.

It is essential that at least one surface of the box have an access port which may be of any desired shape including polygonal, a closed curve, star slot, etc., and which preferably is a circular opening or hole. The terms "box" and "carton" are used interchangeably. A variety of known rigid box constructions may be used with the present invention depending upon the product to be packaged and the functional requirements for the intended product and use. It is also essential in the present invention that the boxes be polymeric and at least partially be either translucent or transparent.

Suitable boxes will have a stable base capable of standing upon a flat shelf and have a rigid self-supporting wall whose stiffness and support is independent of the presence or absence of any product contained therein. The self-supporting upstanding wall may be in the form of a continuous curve established by a defined set or variable distance from one or more vertical axes and may have, for example, a circular or oval cross-section or have an undulated appearance e.g. be hourglass shaped or the like. An upstanding wall may be defined by a surface of revolution which may have no flat surfaces or which may be interrupted by one or more flat wall surfaces. The wall may also have two or more connected surfaces having e.g. a lens cross-section. A lens shaped wall is a two-sided figure formed from two arcuate surfaces; both arcs are convex with respect to the interior of the figure. It has two vertices where the arcs meet. In addition, the upstanding wall may be polygonal in nature having three or more sides. The box will also have a top surface which may have a wide variety of shapes including for example a flat panel which is either parallel to the base or at an angle thereto, or an inverted "V" like the peak of a house, or a variety of curved surfaces such as an inverted "U", or a variety of flat surfaces which are either parallel to the base or angled with respect thereto but which have a perimeter defined by the upstanding wall including circular, oval, lens, triangular, square, rectangular or polygonal in shape. A preferred box shape will be a parallelepiped six sided box. Another preferred shape is "quadral" which is hereby defined as having an appearance of being a quadrilateral box having two opposing connected convex side wall panels (i.e. lens cross-section) with a spaced apart (i) flat base and (ii) parallel flat top. Another shape is an extended quadral in which the two convex side wall panels are spaced apart by two, preferably flat, panels which extend from top to base and which are also spaced apart from each other.

Box Thickness

The carton blanks for the box construction will suitably have a total thickness of at least about 8 mils, and beneficially a total thickness of from about 10 to 20 mils (250-500 microns (μ)). Preferred embodiments may have a thickness from about 12 to 18 mils. For example, the entire carton blank thickness for the box can have any suitable thicknesses, including 8, 9, 10, 11, 12, 13, 14, 15, or 20 mils, or any increment of 0.1 or 0.01 mil therebetween. Although suitable box wall and panel thicknesses for packaging, e.g. beverages, as thick as 30 mils (762 microns) or higher, or as thin as 8 mil (203 microns) or less may be made, it is expected that the most common box wall and/or panel thicknesses will be between about 12-18 mil (305-457 microns). Such sheets may have excellent optical properties, high compression strength, high stiffness, good abuse resistance and machinability. Carton blank sheets over 18 mil in thickness are heavier than necessary for most applications, more expensive from a material cost and more difficult to efficiently soft crease.

Box Layers

The box may be a monolayer or a multilayer construction. Carton blank sheets of 1, 2, 3, 4, or more layers are contemplated for the box construction. For most flowable products, a monolayer sheet, e.g. of a polyester such as APET or RPET, may be used.

In other embodiments, the box can comprise or consist essentially of a PVC, PP, polystyrene or nylon composition. In all embodiments, the box material will provide at least one surface which is at least partially translucent or transparent. If nylon is used, the nylon composition may comprise at least one semi-crystalline nylon homopolymer or copolymer such as nylon 6, 11, 12, 66, 6/12, 6/69, 6/66, MXD6, or an amorphous nylon such as nylon 6I/6T copolymer or blends thereof.

In a preferred embodiment of the invention, one or more of the exterior box panels or walls and most preferably the entire carton blank comprises at least one polyester polymer. Preferred polyester polymers comprise aromatic polyesters and more preferably, are homopolymers or copolymers of poly (ethylene terephthalate) (PET), poly (ethylene naphthalate) and blends thereof. Suitable polyesters may have an intrinsic viscosity of about 0.60 to about 1.2, preferably between 0.60 to 0.80. The polyester may be an aliphatic polyester resin, but is preferably an aromatic polyester resin. For example, polyester materials can be derived from dicarboxylic acid components, including terephthalic acid and isophthalic acid as preferred examples, and also dimers of unsaturated aliphatic acids. Examples of a diol component as another component for synthesizing the polyester may include: polyalkylene glycols, such as ethylene glycol, propylene glycol, tetramethylene glycol, neopentyl glycol, hexamethylene glycol, diethylene glycol, poly-ethylene glycol and polytetra methylene oxide glycol; 1,4-cyclohexanedimethanol, and 2-alkyl-1,3-propanediol. More specifically, examples of dicarboxylic acids constituting the polyester resin may include: terephthalic acid, isophthalic acid, phthalic acid, 5-t-butylisophthalic acid, naphthalenedicarboxylic acid, diphenyl ether dicarboxylic acid, cyclohexane-dicarboxylic acid, adipic acid, oxalic acid, malonic acid, succinic acid, azelaic acid, sebacic acid, and dimer acids comprising dimers of unsaturated fatty acids. These acids may be used singly or in combination of two or more species. Examples of diols constituting the polyester resin may include: ethylene glycol, propylene glycol, tetramethylene glycol, neopentyl glycol, hexamethylene glycol, diethylene glycol, polyalkylene glycol, 1,4-cyclohexane-dimethanol, 1,4-butanediol, and 2-alkyl-1,3-propane diol. These diols may be used singly or in combination of two or more species.

Polyester compositions that comprise an aromatic polyester resin comprising an aromatic dicarboxylic acid component are preferred, including, e.g., polyesters between terephthalic acid (as a dicarboxylic acid) and diols having at most 10 carbon atoms, such as polyethylene terephthalate and polybutylene terephthalate. Particularly preferred examples thereof may include: copolyesters obtained by replacing a portion, preferably at most 30 mol %, more preferably at most 15 mol %, of the terephthalic acid with another dicarboxylic acid, such as isophthalic acid; copolyesters obtained by replacing a portion of the diol component such as ethylene glycol with another diol, such as 1,4-cyclohexane-dimethanol (e.g., "Voridian 9921", made by Voridian division of Eastman Chemical Co.); and polyester-polyether copolymers comprising the polyester as a predominant component (e.g., polyester-ether between a dicarboxylic acid component principally comprising terephthalic acid or/and its ester derivative and a diol component principally comprising tetramethylene glycol and tetramethylene oxide glycol, preferably containing the polytetra methylene oxide glycol residue in a proportion of 10-15 wt. %). It is also possible to use two or more different polyester resins in mixture. Examples of preferred polyesters are available under the trademarks Voridian 9663, Voridian 9921 and EASTAR® Copolyester 6763, all from Eastman Chemical Company, Kingsport, Tenn., U.S.A.

APET and PETG are highly preferred and may advantageously be soft creased which avoids visually undesirable whitened fold areas. Suitable APET and PETG carton blanks may be obtained from HLP Klearfold of Torrance, Calif. These blanks may be formed into boxes which are capable of layflat storage and transportation while also being designed and capable of quick assembly by hand or machine including fully automated equipment into boxes into which bags containing product may be inserted, attached and sealed.

The bag is attached to the interior of the box. Preferably, this attachment is made proximate to the access port of the box. This attachment facilitates insertion through the port of communication means for removal of the bag contents such as a straw, or fixture e.g. a pump, tap, valve or other devices for accessing and removing the bag contents. The bag may be attached to the box at other points or bag/box interfaces both proximate or distal from the port as desired. The attachment may be made by any suitable means including e.g. use of adhesives, heat sealing, ultrasonic or RF sealing, etc. A preferred means of attachment is by adhesive.

Adhesives useful in the present invention include permanent adhesives, hot melt adhesives, modified polymer adhesives and polymer resins commonly available from many commercial sources. It is contemplated that acrylic and anhydride modified polymers may be employed as well as many adhesives which may be selected depending upon the materials to be attached and equipment utilized.

Clarity is measured using the clarity port of a a BYK Gardner Haze-Gard in accordance with its instructions and the teaching of ASTM D-1003. Clarity is defined as the percentage of transmitted light that deviates from the incident light by less than 2.5 degrees.

Following are examples given to further illustrate the invention, but these examples should not be taken as limiting the scope. All percentages are by weight unless indicated otherwise.

Reported properties for the bags and boxes described herein are based on the following test methods or substantially similar test methods unless noted otherwise.

Oxygen Gas Transmission Rate ($O_2$GTR): ASTM D-3985-81

Water Vapor Transmission Rate (WVTR): ASTM F 1249-90

Gauge: ASTM D-2103

Melt Index (MI): ASTM D-1238, Condition E (190° C.) (except for propene-based (>50% $C_3$ content) polymers tested at Condition TL (230° C.))

Melting point (m.p.): ASTM D-3418, DSC with 5° C./min heating rate

Glass transition temperature $T_g$ ASTM D3418

Gloss: ASTM D-2457, 60° angle

Haze: ASTM D-1003

Elmendorf Tear: ASTM D-1922

Compression: ASTM F-1621

Puncture: ASTM F-1306

Stiffness: ASTM D-6125-97 or TAPPI #T543

Unless otherwise noted, the thermoplastic resins utilized in the present invention are generally commercially available in pellet form and, as generally recognized in the art, may be melt blended or mechanically mixed by well-known methods using commercially available equipment including tumblers, mixers or blenders. Also, if desired, well known additives such as processing aids, slip agents, anti-blocking agents and pigments, and mixtures thereof may be incorporated into the film or applied to one or more surfaces thereof, e.g. by blending prior to extrusion, powdering, spraying, contact roller application, etc. Typically the resins and any desired additives are mixed and introduced to an extruder where the resins are melt plastified by heating and then transferred to an extrusion (or coextrusion) die. Extruder and die temperatures will generally depend upon the particular resin or resin containing mixtures being processed and suitable temperature ranges for commercially available resins are generally known in the art, or are provided in technical bulletins made available by resin manufacturers. Processing temperatures may vary depending upon other processing parameters chosen.

EXAMPLES 1-3

Example 1

Table 1 illustrates a thirteen-layer coextruded palindromic packaging film useful in the present invention as illustrated in film 10 of FIG. 1 above. The film web is typically formed as a blown film having seven layers which is then collapsed and moved through nip rollers applying heat and pressure to cause the interior layer of the blown film bubble to weld to itself thereby creating a thirteen layer film of a palindromic structure as represented in TABLE 1. The collapsed bubble forms a film sheet which has a total collapsed film thickness of about 3.0 mil (76.2 microns). Table 1 provides the details of the identity of the various materials present in each of the film layers, the arrangement of each of the film layers, and the relative proportions of each of the materials in each of the film layers.

TABLE 1

| FIG. 1 Number | Layer Composition Identifier | % Layer Thickness | Composition |
|---|---|---|---|
| 11 | A | 12.85 | 82.4% $C_2C_8$ LLDPE<br>10.0% $C_2C_8$ VLDPE<br>7.6% Additives |
| 12 | B | 7.55 | 80% $C_2C_8$ LLDPE<br>20% anhydride modified LLDPE |
| 13 | C | 3.9 | 80.00% nylon 6<br>20.00% nylon 6/66 |
| 14 | D | 10.55 | 100% (wt.) EVOH (38 mol %) |
| 15 | E | 3.9 | 80.00% nylon 6<br>20.00% nylon 6/66 |
| 16 | F | 5.6 | 80% $C_2C_8$ LLDPE<br>20% anhydride modified LLDPE |
| 17 | G | 11.2 | 100% (wt.) EVA (12% VA) |
| 18 | F | 5.6 | 80% $C_2C_8$ LLDPE<br>20% anhydride modified LLDPE |
| 19 | E | 3.9 | 80.00% nylon 6<br>20.00% nylon 6/66 |
| 20 | D | 10.55 | 100% (wt.) EVOH (38 mol %) |
| 21 | C | 3.9 | 80.00% nylon 6<br>20.00% nylon 6/66 |
| 22 | B | 7.55 | 80% $C_2C_8$ LLDPE<br>20% anhydride modified LLDPE |
| 23 | A | 12.85 | 82.4% $C_2C_8$ LLDPE<br>10.0% $C_2C_8$VLDPE<br>7.6% Additives |

An example of a commercially available linear low-density polyethylene $C_2C_8$ LLDPE suitable for use in the present invention includes, but is not limited to, Dowlex® 2045G having a reported density of 0.920 g/cm$^3$, a melt index of 1.0 dg/min., and a m.p. of about 122° C., which is supplied by The Dow Chemical Company of Midland, Mich., U.S.A.

Exemplary of commercially available VLDPEs suitable for use in the present invention include, but are not limited to, the $C_2C_8$Attane® family of resins, e.g., Attane® NG 4701G having a reported density of 0.912 gram/cm$^3$, a melt flow index of 0.8 decigram/min., which is supplied by The Dow Chemical Company of Midland, Mich., U.S.A.

Exemplary of commercially available anhydride-modified linear low-density polyethylenes (modLLDPE) suitable for use in the present invention include, but are not limited to, the BYNEL® family of resins, e.g., BYNEL® 41E710 grade having a reported melt index of 2.7 dg/min. (at 190° C.), a density of 0.91 g/cm$^3$, and a melting point of 115° C., which is supplied by E. I. du Pont de Nemours and Company, Wilmington, Del., U.S.A.

Exemplary of commercially available ethylene/vinyl alcohol copolymers suitable for use in the present invention include, but are not limited to, the SOARNOL® family of resins, e.g., SOARNOL® ET3803 grade having a reported bulk density of 0.64-0.74 gram/cm$^3$, a relative density of 1.13-1.22 gram/cm$^3$, a melting point of 164-188° C., which may be obtained from The Nippon Synthetic Chemical Industry Company, Ltd. (Nippon Gohsei), Osaka, Japan.

Exemplary of commercially available polyamides suitable for use in the present invention include, but are not limited to, the ULTRAMID® family of resins, e.g. ULTRAMID® B36 nylon 6 having a glass transition temperature (Tg) of 127° C., a density of 1.13 g/cm3, and tensile strength (at yield) of 131,000 psi, and C40 nylon 6/66 having a m.p. 193° C., and a density of 1.12 g/cm3, both of which may be obtained from BASF, Mount Olive, N.J., U.S.A.

An example of commercially available ethylene vinyl acetate copolymer (EVA) includes, but is not limited to, Elvax® 3135XZ EVA having a reported vinyl acetate (VA) content of 12%, a density of 0.930 gram/cm$^3$, a melt index of 0.35 gram/10 min., a melting point of 95° C., which is supplied by E. I. du Pont de Nemours and Company, Wilmington, Del., U.S.A.

The films according to the present invention may be fabricated by any coextrusion method known to a person of ordinary skill in the art. The film of TABLE 1 may be manufactured by the following steps: (a) adding thermoplastic resins to extruders for extrusion into a seven-layer film; (b) heating the thermoplastic resins to form streams of melt-plastified polymers; (c) forcing the streams of melt-plastified polymers through a multi-orifice annular blown film die to form a tubular extrudate having a diameter and a hollow interior; (d) expanding the diameter of the tubular extrudate by a volume of gas entering the hollow interior via the central orifice; and (e) collapsing the expanded blown film tubular extrudate onto itself using heated nip rollers to form the final film structure.

Examples 2-3

Table 2 illustrates multilayer coextruded packaging films useful in the present invention. Except as noted, the films made are as described above for Example 1. The film structures for Examples 2 and 3 are as disclosed in Table 2. Example 2 is a collapsed bubble 13 layer film whereas Example 3 is a seven layer asymmetrical film construction; it is not a collapsed bubble. The collapsed film of Example 2 is 3 mil thick whereas the film of Example 3 has a thickness of 1.75 mil.

TABLE 2

| | Ex. 2 | | Ex. 3 | |
|---|---|---|---|---|
| Layer # | Composition | % t | Composition | % t |
| 1 | 87.2% $C_2C_6$ mVLDPE<br>12.8% Additives | 18 | 92.2% $C_2C_8$ VLDPE<br>7.2% Additives | 8 |
| 2 | 80% $C_2C_8$ LLDPE<br>20% anhydride modified LLDPE | 7.5 | 90% $C_2C_8$ VLDPE<br>10% anhydride modified LLDPE | 12 |
| 3 | 80.00% nylon 6<br>20.00% nylon 6/66 | 4 | 100% nylon 6/66 | 7 |
| 4 | 100% (wt.)<br>EVOH (29 mol %) | 6.5 | 100% (wt.)<br>EVOH (38 mol %) | 9 |
| 5 | 80.00% nylon 6<br>20.00% nylon 6/66 | 4 | 100% nylon 6/66 | 7 |
| 6 | 80% $C_2C_8$ LLDPE<br>20% anhydride modified LLDPE | 5 | 80% EVA (18% VA)<br>20% anhydride modified LLDPE | 22 |
| 7 | 100% (wt.)<br>EVA (12% VA) | 10 | 100% (wt.)<br>EVA (18% VA) | 35 |
| 8 | 80% $C_2C_8$ LLDPE<br>20% anhydride modified LLDPE | 5 | | |
| 9 | 80.00% nylon 6<br>20.00% nylon 6/66 | 4 | | |
| 10 | 100% (wt.)<br>EVOH (29 mol %) | 6.5 | | |
| 11 | 80.00% nylon 6<br>20.00% nylon 6/66 | 4 | | |
| 12 | 80% $C_2C_8$ LLDPE<br>20% anhydride modified LLDPE | 7.5 | | |
| 13 | 87.2% $C_2C_6$ mVLDPE<br>12.8% Additives | 18 | | |

Other examples of film structures for bags include:

LLDPE monolayer; EVA monolayer; HDPE monolayer; PE/EVA/tie/EVOH/tie/EVA;

PE/EVA/tie/EVOH/tie/EVA/PE; Ionomer/tie/EVOH/tie/Ionomer/tie/EVOH/tie/Ionomer;

EVA/tie/EVOH/tie/EVA/tie/EVOH/tie/EVA; EVA/PE/COC/tie/EVOH/tie/COC/PE/EVA; EAO/tie/EVOH/tie/EVA/tie/EVOH/tie/EAO; PET/PE; PET/tie/polyolefin. Bags may also be made by sealing a plurality of webs together e.g. as a four sided pouch or to form a tube of having differing wall portion compositions. For example, an metal foil laminate such as aluminum foil/PE may be used as an opaque back wall of a bag by sealing its perimeter to a translucent or preferably transparent front wall film of a plastic such as polyethylene or LLDPE/EVA; similarly a colored or opacified PP/PE laminate may be edge sealed to a transparent or translucent plastic film to make a film sheet that can be formed into a bag having both transparent or translucent and/or opaque wall portions. In another embodiment, plastic may be extruded by bringing together using known means different streams of polymer melts utilizing laminar flow to create a film sheet or tube which has varying optical properties e.g. ranging from opaque to translucent to transparent with abrupt or gradual changes is visual appearance. Such bags will have at least a portion which is transparent or translucent to provide visual access to the bag contents.

The films of the Examples above may each be used make packages containing a flowable material e.g. by utilizing vertical form-fill-seal (VFFS) equipment to make a pouch or bag filled with a liquid such as a juice beverage. As used herein the term "bag" includes pouches and flexible packages made from flexible films having 1, 2, 3, 4 or more seals. This bag may include a defined headspace or be designed for zero headspace in the flexible bag. The present invention does not employ lock rings to hold an open bag mouth against a rigid box e.g. at the box perimeter. Instead, the filled flexible bag package is either sealed and then inserted into a rigid transparent box or placed in the box and sealed, but the bag is sealed to itself to close in accordance with the present invention. The bag is however attached to the box about an access port to provide a puncture access point for establishing connection with communications means. Suitable transparent boxes are commercially available from HLP Klearfold of Torrance, Calif., USA. These boxes may be printed as desired and modified to provide for an access port e.g. by making a hole in a wall surface, preferably the top surface of a parallelepiped shaped box e.g. by mechanical, heat or laser means such as punching, die cutting, laser cutting, piercing with heated tools, etc. The hole is adapted for providing communication means for removing product from the bag.

Comparative Examples 4-9

In these comparative examples 4-9, samples of 6 different commercially available packages were tested and compared. Each of comparative examples 4-8 is a rigid parallelepipedal box having a rectangular prism shape with a length×width×height in inches (") as indicated. Comparative example 9 is a flexible stand up pouch (SUP). Comparative Examples 4-8 are each believed to be a laminate of the following construction: Printed paperboard/PE/foil/polyolefin with the Tetra Brik® examples believed to have an exterior layer of LDPE laminated over the printed paperboard. Comparative example 4 was a commercially obtained 4.23 ounce (oz) Apple and Eve brand drink box of a typical Sig Combibloc® construction for packaging apple juice and had width, length, and depth dimensions of 2"×2.75"×1.5". Comparative example 5 was a commercially obtained 6 oz Minute Maid® brand drink box of a typical Tetra Brik® construction for packaging orange juice having dimensions of 1.5"×4.125"×1.875". Comparative example 6 was a commercially obtained 6.75 oz Nestle Juicy Juice brand drink box of a typical Tetra Brik® construction for packaging juice and had width, length, and depth dimensions of 1.5"×4.75"×1.875". Comparative example 7 was a commercially obtained 18.3 oz Campbell's® Gourmet Bisque brand liquid soup box of a typical Combibloc® construction for packaging bisque having dimensions of 3"×5.625"×1.875". Comparative example 8 was a commercially obtained 48 oz Swanson® brand chicken broth box of a typical Tetra Brik® construction for packaging broth having dimensions of 4.5"×6.6875"×2.875". Comparative example 9 is a commercially obtained 6 ounce Capri Sun® stand up pouch (SUP) for packaging a liquid beverage. Physical properties including optical properties, stiffness were determined. All comparative samples were opaque, fully preventing visual observation of any package contents. Other physical properties are presented in Table 3.

TABLE 3

| | | | | | | | Compression Test | |
|---|---|---|---|---|---|---|---|---|
| # | Structure | Gauge mil | Gloss at 60° | Gurley Stiffness mg force MD/TD | Puncture Resistance lb force | Leakage Test # | t sec | buckling lb force |
| 4 | Rigid Combibloc ® Box 4.23 oz | 13.35 | 10 | 3,035/1,739 | 1.9 | 2/3 | 38 | 26 |
| 5 | Rigid Tetra Brik ® Box 6 oz | 12.75 | 24 | 3,956/2,200 | 1.4 | 1/3 | 67 | 22 |
| 6 | Rigid Tetra Brik ® Box 6.75 oz | 12.75 | 32 | 3,716/2,151 | 1.4 | 3/3 | 86 | 28 |
| 7 | Rigid Combibloc ® Box 18.3 oz | 14.5 | 26 | 7,432/4,605 | ND | ND | 50 | 45 |
| 8 | Rigid Tetra Brik ® Box 48 oz | 22.25 | 34 | 25,283/13,299 | ND | ND | 119 | 63 |
| 9 | Flexible SUP 6 oz | 4.35 | 101 | 70/87 | 2.3 | 0/3 | 38 | NA |

ND = Not Determined
NA = Not Applicable

All of the comparative packages by design utilize materials in their package walls which render them opaque. The stiffness values indicate that the boxes (Examples 4-8) are rigid and the SUP is flexible. Examples 5 and 9 had access ports designed for insertion of communication means in the form of a rigid plastic straw. The puncture resistance of this area was tested for box of example 5 and the stand up pouch. The box to make straw insertion possible has a circular cut out portion from which paper layer(s) are absent and which is covered by internally disposed foil and film layers. The access ports of the box and the SUP are believed to be typical and representative of commercial drink box access ports. A leakage test was performed on the drink boxes of examples 4-6 as well as the stand up pouch of example 9. In this test a rigid straw was inserted through the access port and wiggled back and forth 20 times. Then the liquid filled package was tipped over several times and observed for leakage adjacent the straw puncture site. The number of packages exhibiting leakage is reported as number leaked per number tested. It is seen that the rigid drink boxes exhibited leaks 33-100% of the samples tested, whereas no leakage at the puncture site of the tested SUP was observed.

In the compression test each package sample containing liquid was placed between compression plates of a tensile tester with the top of each package (width×depth) adjacent to the top compression plate. The compression properties were measured by a test similar to ASTM F-1621 using a crosshead speed of 1 inch per minute. The time to failure from leakage of the liquid out of the package was measured and reported, as was the force required to cause the box wall to buckle. The SUP being flexible was not tested for buckling. A defect in appearance of commercial boxes is the denting and buckling of corners and walls when subjected to forces e.g. from stacking, dropping or movement during packing, unpacking, shipping and the like. If the buckling forces are too severe package failure occurs and the barrier to the contents is compromised and content leakage may be apparent. Even if visual leakage does not occur the barrier properties of the container wall may be diminished or otherwise impaired leading to loss of shelf life or product deterioration. The values presented are believed to be representative and typical of the resistance to denting and buckling and ultimately leakage for these types of commercial containers.

Examples 10-14

In Examples 10-14, samples of the transparent bag films and three transparent plastic boxes suitable for use in the present invention were tested. In Example 10 a blown film was made by coextrusion and the resultant 2.5 mil thick film had a seven layer structure of: VLDPE:LLDPE/LLDPE:EVA/tie/EVOH/tie/VLDPE:EVA/mEAO:LDPE. In Example 11 a blown film was made by coextrusion and the bubble of 1.75 mil thick seven layer film was collapsed to form a resultant 3.5 mil thick film having a thirteen layer structure of: mEAO/tie/PA/EVOH/PA/tie/EVA/tie/PA/EVOH/PA/tie/mEAO. Examples 12-14 are each rigid cartons from HLP Klearfold having a reported thickness of 14 mil and soft creased to form an assembled parallelepipedal box having a rectangular prism shape with a length×width×height of 3"×5.675"×1.875" to form a regular six-sided box having a volume of about 14.5 oz. The carton of Example 12 is made of 14 mil APET sheet. The carton of Example 13 is made of 14 mil PVC sheet. The carton of Example 14 is made of 14 mil high clarity polypropylene sheet. Reported and measured physical properties are listed below in Table 4.

TABLE 4

| # | Structure | Gauge mil | Gloss at 60° | Haze % | Clarity % | Gurley Stiffness mg force MD/TD | Puncture Resistance lb force | Leakage test # |
|---|---|---|---|---|---|---|---|---|
| 10 | VLDPE:LLDPE/LLDPE:EVA/tie/EVOH/tie/VLDPE:EVA/mEAO:LDPE film | 2.5 | 85 | 13 | 87 | 5/6 | 2.0 | 0/3 |
| 11 | mEAO/tie/PA/EVOH/PA/tie/EVA/tie/PA/EVOH/PA/tie/mEAO film | 3.5 | 75 | 24 | 78 | 10/11 | 4.1 | 0/3 |
| 12 | APET carton | 14 | 143 | 3 | 99 | 3,627/3,588 | NA | NA |
| 13 | PVC carton | 14 | 141 | 7 | 95 | 3,289/3,058 | NA | NA |
| 14 | high clarity PP carton | 14 | 135 | 11 | 99 | 2,720/2,676 | NA | NA |

NA = Not Applicable

The films and cartons of the Examples 10-14 all exhibit excellent optical properties having high gloss, low haze and a high degree of clarity.

The Gurley stiffness values for the films are low and are indicative of films having high conformability. In comparison the SUP film of Example 9 has a stiffness value of 70/87 which although still indicative of a flexible film, is suitably higher for its intended purpose as a stand up pouch. Preferably, the films of the present invention will have a Gurley stiffness less than 20 mg force to maximize conformability to the interior geometry of the rigid carton within which the bag is disposed in use. This conformability produces a bag-in-box combination of pleasing appearance with a minimum of wrinkles, and having excellent visibility of bag contents through the transparent viewing portions of the combined box and bag walls. Optical distortion is minimized. Bag content volume is maximized with efficient use of the bag material at the lowest possible weight for the geometry. Bag films having a Gurley stiffness greater than 50 mg force, while functionally workable are less desirable and may be commercially unacceptable due to visible wrinkling and folds with attendant loss of volume. Thus, bags having a Gurley stiffness of less than 50 milligrams force may advantageously be employed, and preferably <20 milligrams force.

The puncture resistance of the Example 10-11 bag films ranged from about 2 to 4 pounds compared to 1.4 to 2.3 for the commercially acceptable access port cover films of Examples 5 and 9. This indicates the suitability of these films of Examples 10-11 for use in the access port area to provide a means for insertion of communication means by hand e.g. a rigid drinking straw. Of course, films with higher puncture resistance may be employed and mechanical assists may be used to attach other communications e.g. fixtures for valved delivery, pumps, taps, etc. Also, lower puncture resistance values may be obtained, if desired, e.g. by reducing film thickness or by modification of the film process conditions or formulation e.g. by choice of processing temperatures which affect film orientation or by choice of resins, polymers, additives or other materials to provide a combination having lower puncture resistance. For example, a 0.8 mil transparent monolayer film of a blend of LLDPE and LDPE may be made having a puncture resistance of 1.2 pounds force or a 1.15 mil three layer film of PP/LLDPE/EVA having a puncture resistance value of 0.8. Specific variations will be dependent upon the desired combination of film properties and may be achieved without undue experimentation in light of the present teachings.

Commercially available large capacity (1.5 liters) opaque metallized film containing flexible SUP films for wine exist which have a thickness of about 7.2 mil and a Gurley stiffness of 360/365 MD/TD. These films are thick but nonetheless flexible and not rigid. Rigid film or sheet structures in accordance with the present invention must be capable of forming rigid box like containers of 100 to 500 ml, and preferably up to 1 liter, containers where the rigid film or sheet has a Gurley stiffness value of at least 1000 milligrams force. The bag used with these rigid boxes of the invention much be supple and conformable, typically having a thickness <5 mil and a Gurley stiffness <50 milligrams force. The above wine SUP is too stiff to properly conform to the interior box surfaces and would present a highly wrinkled and unsuitable appearance with a diminished volume capacity.

A wine bag-in-box film was examined which had a 3.65 mil outer film ply which of itself has a puncture resistance of 6.2 pounds force. This outer ply is coupled to an inner ply of 1.5 mil thickness which in itself has a puncture resistance of 1.4 pounds force. Thus, it is believed that existing commercial foil containing wine bag-in-box film structures have puncture resistance values too high for manual rigid straw insertion for single serve drink box applications. Preferably, for manual straw insertion through an access port film a puncture value of less than or equal to 5 pounds force is desired. Also, as a point of reference an HDPE monolayer milk jug having a thickness of ~17 mil has a puncture resistance of about 17 pounds force.

The same leakage test performed for comparative examples 4-6, and 9 was performed on film examples 10-11. For film samples 10 and 11 pouches made and filled with water were placed inside plastic cartons having an access port hole in the top with the bag adhesively attached. The adhesive did not extend over the access port and was not in contact with the inserted straw. No leaks were observed at the puncture site of the tested films indicating that use of these films would be an improvement over the tested commercial rigid box structures with respect to the parameter tested. It is believed that this test indicates that less immediate leakage will occur during "tip over" events e.g. as may be expected with young children handling juice boxes. It is believed without wishing to be bound by the belief that sealing against leaks is enhanced by use of package materials covering the access port which are free of metal foil. It is further believed that the leakage test results may correspond to Elmendorf Tear values. Increased incidence of leakage may occur with materials having Elmendorf Tear values less than 100 and especially less than 90 g in each of the machine and transverse directions (MD & TD). A low incidence of leakage by this test is expected for materials having an Elmendorf Tear greater than 90 g in at least one direction and preferably both MD and TD.

Examples 15-19

The compression test described above with respect to Comparative Examples 4-8 was performed for three bag-in-box containers of the present invention. Examples 15-17 were the cartons of Examples 12-14 into which a water filled bag made from the film of Example 11 was affixed. Each box had an access port in the form of a ¼" circular hole centrally located in the top flap. A bag was made from the film by folding a sheet and heat sealing together its longitudinal ends to form a lap seal and by forming two spaced apart transverse seals. The bag was filled with water leaving essentially zero gas headspace before making the final seal.

The sealed filled bag was inserted into a box formed from an assembled carton and a hot melt adhesive was applied on the interior surface of the box top around the access port opening so that the filled bag was sealed to the closed box top in a circular seal around the access port without occluding the opening with adhesive. The assembled bag-in-box was similar to that disclosed in FIGS. 3-7 of the drawings. For Examples 18 and 19, similar filled bag-in-box containers were made as for Examples 15-17 except that 12 mil rigid APET cartons having access ports were assembled into boxes having dimensions of 3"×4"×1.5" with Example 18 being loaded a pouch made from the 2.5 mil film of Example 10 (Example 19 used an appropriately sized pouch made from the same 3.5 mil pouch film used in Examples 11, and 15-17. The time to bursting or leakage of the liquid for each bag-in-box of Examples 15-19 was 116, 189, 219, 117, and 155 seconds respectively. The compression strength force to initial buckling for each Example was 57, 85, 37, 51, and 57 pound force, respectively. The novel transparent bag-in-box containers of the present invention exhibited greatly increased times to leakage compared to the commercial Tetra Brik® and Combibloc® packages of Comparative Examples 4-8. These compression test results show a 600% to over 3600% increase in the time to leakage at a constant crosshead speed of 1" per minute for the foil-free bag-in-box packaging. The pounds force required for initial rigid wall package buckling ranged from 26-71 pounds for comparative examples 4-8 and for the invention was much improved, ranging from 37-85 pounds. When examples 15-17 of the present invention are compared to Comparative Example 5 which had similar geometries of 3"×5.625"×1.875 an increase in force required from the 27 pounds of Example 5 to 37 to 85 pounds for Examples 15-17 is observed, a 37% to 215% improvement with only a 20% increase in total thickness all of which is attributable to addition of the flexible bag. Thus, it is seen that the present bag-in-box containers have properties believed to be indicative of fewer defects in appearance relative to commercial boxes regarding the propensity for denting and buckling of corners and walls when subjected to forces e.g. from stacking, or movement during packing, unpacking, shipping and the like. In addition, the containers of Examples 15-19 did not burst or leak until reaching forces of 275, 131, 117, 78, and 108 pounds respectively. Whereas the Comparative rigid Tetra Brik® and Combibloc® packages of Comparative Examples 4-8 began leaking at forces of 109, 113, 120, 155, and 354 pounds force, respectively these comparative examples all leaked much earlier than the containers according to the present invention. This is believed to be due to the enhanced dual protection offered by the invention' use of an outer rigid box coupled to an inner flexible bag. The present invention has stronger protection against leakage as measured by this test.

Embodiments of the Invention 1. a retail bag-in-box package comprising:
   a flowable product, a bag, and a box; the product contained in the bag which is contained in the box; wherein (a) the box is plastic and has (i) a bottom panel, an opposing top panel, and a self-supporting upstanding wall connecting the bottom and top panels wherein at least a portion of the wall is transparent, and (ii) an access port through the box adapted for providing communication means for removing the product from the bag; and (b) the bag is made from a flexible thermoplastic film, hermetically sealed to itself, and containing the product with a bag volume capacity ≤1 liter (1000 ml), the bag attached to an interior surface of the box proximate the access port, wherein at least a portion of the bag has a transparent wall which overlaps the transparent portion of the box wall to provide visual access to a product contained within the bag.

2. A retail bag-in-box package, as defined in embodiments 1-23, wherein the bag has from 1 to 15 layers.

3. A retail bag-in-box package, as defined in embodiments 1-23, wherein the bag has a WVTR of less than 0.5 g/100 $in^2$/24 hours at 100° F. (38° C.), 90% Relative Humidity (R.H.), and 1 atmosphere.

4. A retail bag-in-box package, as defined in embodiments 1-23, wherein the bag has a WVTR of less than 0.1 g/100 $inches^2$ per 24 hours at 100° F. (38° C.), 90% Relative Humidity (R.H.), and 1 atmosphere.

5. A retail bag-in-box package, as defined in embodiments 1-23, wherein the bag comprises at least five layers including a heat sealable layer, and a layer of EVOH.

6. A retail bag-in-box package, as defined in embodiments 1-23, wherein the bag has an $O_2$TR value of less than or equal to 10 $cm^3$/100 $in^2$/24 hours at 1 atmosphere, 23° C. and 0% RH.

7. A retail bag-in-box package, as defined in embodiments 1-23, wherein at least one of the bag and box comprises an ultraviolet light blocking material.

8. A retail bag-in-box package, as defined in embodiments 1-23, wherein the box has intersecting walls with soft crease score lines.

9. A retail bag-in-box package, as defined in embodiments 1-23, wherein the bag and the box each have a haze value of less than 50%.

10. A retail bag-in-box package, as defined in embodiments 1-23, wherein the bag and the box each has a portion of the transparent bag wall and box wall having a clarity of at least 50%.

11. A retail bag-in-box package, as defined in embodiments 1-23, wherein the bag and the box each has a portion of the transparent bag wall and box wall having a clarity of at least 75%.

12. A retail bag-in-box package, as defined in embodiments 1-23, wherein the transparent bag wall and box wall has a clarity of at least 90%.

13. A retail bag-in-box package, as defined in embodiments 1-23, wherein the bag has an elmendorf tear strength value of at least 100 grams in at least one of the machine and transverse directions.

14. A retail bag-in-box package, as defined in embodiments 1-22, wherein the product comprises a liquid.

15. A retail bag-in-box package, as defined in embodiments 1-23, wherein the box comprises amorphous polyethylene terphthalate (APET).

16. A retail bag-in-box package, as defined in embodiments 1-22, wherein the box wall has a Gurley stiffness of at least 1000 milligrams force.

17. A retail bag-in-box package, as defined in embodiments 1-23, wherein the bag film has a Gurley stiffness of less than 50 milligrams force.

18. A retail bag-in-box package, as defined in embodiments 1-23, wherein the bag further comprises communication means selected from a rigid straw, a pump, a tap, a valve, a sprayer, a flip top closure, a twist screw cap, a sport cap, a dispensing cap, and a snap cap hingedly covering a tubular opening.

19. A retail bag-in-box package, as defined in embodiments 1-23, wherein the bag further comprises communication means selected from the group of fitments comprising a pump, a tap, a valve, a snap cap hinged covered tubular opening and the fitment is sealed to the bag; and the box access port is an opening through which the fitment projects.

20. A retail bag-in-box package, as defined in embodiments 1-23, wherein the bag has a volume capacity of ≤500 ml.

21. A retail bag-in-box package, as defined in embodiments 1-22, wherein the box wall has a thickness of at least 8 mil.

22. A retail bag-in-box package, as defined in embodiments 1-22, wherein the bag film has a thickness ≤5 mil.

23. A retail single serve, bag-in-box beverage package comprising:

a parallelepiped box of amorphous polyester, glycolized polyester, or polyvinyl chloride polymer, a bag, and a liquid beverage product; the product contained in the bag which is contained in the box; wherein (a) the box is plastic, has a wall thickness of at least 8 mil, and has (i) a flat bottom surface, an opposing top panel, and a self-supporting upstanding four sided wall connecting the bottom and top panels with soft crease score lines wherein at least a portion of at least one side of the wall is transparent, the box wall having a Gurley stiffness value of at least 1000 milligrams force, and (ii) an access port through the box adapted for providing communication means for removing the product from the bag; and (b) the bag is made from a flexible thermoplastic film having a thickness<5 mil and a Gurley stiffness value of less than 20 milligrams force in both MD and TD, hermetically sealed to itself, and containing the product with a bag volume capacity <½ liter attached to an interior surface of the box proximate the access port, wherein at least a portion of the bag wall is a transparent wall portion which overlaps the transparent portion of the box wall to provide visual access to the product contained within the bag.

Various embodiments have been described above. Although the invention has been described with reference to these specific embodiments, the descriptions are intended to be illustrative and are not intended to be limiting. Various modifications and applications may occur to those skilled in the art without departing from the true spirit and scope of the invention as defined in the appended claims.

What is claimed is:

1. A retail bag-in-box package comprising:

a flowable product, a bag, and a box; said product contained in said bag which is contained in said box; wherein (a) said box is plastic and has (i) a bottom panel, an opposing top panel, and a self-supporting upstanding wall connecting said bottom and top panels wherein at least a portion of said wall is transparent, and (ii) an access port through said top panel adapted for providing communication means for removing said product from said bag;

(b) said bag is made from a flexible thermoplastic film, hermetically sealed to itself, and containing said product with a bag volume capacity ≤1 liter (1000 ml), said bag attached to an interior surface of said box proximate said access port, wherein said bag is attached by adhesive, heat sealing, ultrasonic sealing, or radio frequency sealing, and wherein at least a portion of said bag has a transparent wall which overlaps said transparent portion of said box wall to provide visual access to a product contained within said bag, and (c) said flowable product comprises a liquid; and wherein said box wall has a Gurley stiffness of at least 1000 milligrams force and wherein said bag film has a Gurley stiffness of less than 50 milligrams force.

2. A retail bag-in-box package, as defined in claim 1, wherein said bag has from 1 to 15 layers.

3. A retail bag-in-box package, as defined in claim 1, wherein said bag has a WVTR of less than 0.5 g/100in$^2$/24 hours at 100° F. (38° C.), 90% Relative humidity (R.H.), and 1 atmosphere.

4. A retail bag-in-box package, as defined in claim 1, wherein said bag comprises at least five layers including a heat sealable layer, and a layer of EVOH.

5. A retail bag-in-box package, as defined in claim 1, wherein said bag has an $O_2$TR value of less than or equal to 10 cm$^3$/100in$^2$/24 hours at 1 atmosphere, 23° C. and 0% RH.

6. A retail bag-in-box package, as defined in claim 1, wherein at least one of said bag and box comprises an ultraviolet light blocking material.

7. A retail bag-in-box package, as defined in claim 1, wherein said box has intersecting walls with soft crease score lines, whereby whitened fold areas are avoided.

8. A retail bag-in-box package, as defined in claim 1, wherein said bag and said box each have a haze value of less than 50%.

9. A retail bag-in-box package, as defined in claim 1, wherein said bag and said box each has a portion of said transparent bag wall and box wall having a clarity of at least 50%.

10. A retail bag-in-box package, as defined in claim 1, wherein said bag and said box each has a portion of said transparent bag wall and box wall having a clarity of at least 75%.

11. A retail bag-in-box package, as defined in claim 1, wherein said transparent bag wall and box wall has a clarity of at least 90%.

12. A retail bag-in-box package, as defined in claim 1, wherein said box comprises polyester, polyvinyl chloride, polypropylene, polystyrene, or nylon.

13. A retail bag-in-box package, as defined in claim 1, wherein said bag further comprises communication means selected from a rigid straw, a pump, a tap, a valve, a sprayer, a flip top closure, a twist screw cap, a sport cap, a dispensing cap, and a snap cap hingedly covering a tubular opening.

14. A retail bag-in-box package, as defined in claim 1, wherein said bag further comprises communication means selected from the group of fitments comprising a pump, a tap, a valve, a snap cap hinged covered tubular opening and said fitment is sealed to said bag; and said box access port is an opening through which said fitment projects.

15. A retail bag-in-box package, as defined in claim 1, wherein said bag has a volume capacity of ≤500 ml.

16. A retail bag-in-box package, as defined in claim 1, wherein said box wall has a thickness of at least 8 mil.

17. A retail bag-in-box package, as defined in claim 1, wherein said bag film has a thickness ≤5 mil.

18. A retail bag-in-box package comprising:

a flowable product, a bag, and a box; said product contained in said bag which is contained in said box; wherein (a) said box is plastic and has (i) a bottom panel, an opposing top panel, and a self-supporting upstanding wall connecting said bottom and top panels wherein at least a portion of said wall is transparent, and (ii) an access port through said box adapted for providing communication means for removing said product from said bag; and (b) said bag is made from a flexible thermoplastic film, hermetically sealed to itself, and containing said product, said bag attached to an interior surface of said box proximate said access port, wherein said bag is attached by adhesive, and wherein said adhesive does not extend over said access port; and wherein said box wall has a Gurley stiffness of at least 1000 milligrams force and wherein said bag film has a Gurley stiffness of less than 50 milligrams force.

* * * * *